US008457520B2

(12) United States Patent
Kamimura et al.

(10) Patent No.: US 8,457,520 B2
(45) Date of Patent: Jun. 4, 2013

(54) IMAGE FORMING DEVICE HAVING GUIDE MECHANISM FOR GUIDING TRANSFERRING UNIT

(75) Inventors: Naoya Kamimura, Nagoya (JP); Shougo Sato, Seto (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/585,159

(22) Filed: Aug. 14, 2012

(65) Prior Publication Data

US 2012/0308273 A1 Dec. 6, 2012

Related U.S. Application Data

(62) Division of application No. 13/268,290, filed on Oct. 7, 2011, now Pat. No. 8,265,522, which is a division of application No. 12/768,347, filed on Apr. 27, 2010, now Pat. No. 8,064,793, which is a division of application No. 12/238,854, filed on Sep. 26, 2008, now Pat. No. 7,720,413, which is a division of application No. 11/316,946, filed on Dec. 27, 2005, now Pat. No. 7,447,467.

(30) Foreign Application Priority Data

Dec. 27, 2004 (JP) ..... 2004-378081

(51) Int. Cl.
*G03G 15/00* (2006.01)
*G03G 15/16* (2006.01)

(52) U.S. Cl.
USPC ..... 399/110; 399/116; 399/121

(58) Field of Classification Search
USPC ..... 399/110, 111, 116, 121
See application file for complete search history.

(56) References Cited

U.S. PATENT DOCUMENTS

| | | | |
|---|---|---|---|
| 4,963,936 | A | 10/1990 | Carter |
| 4,999,680 | A | 3/1991 | Joseph et al. |
| 5,036,367 | A | 7/1991 | Haneda et al. |
| 5,053,820 | A | 10/1991 | Preszler et al. |
| 5,124,747 | A | 6/1992 | Haneda et al. |
| 5,132,732 | A | 7/1992 | Kalyandurg et al. |
| 5,220,386 | A | 6/1993 | Aoki et al. |
| 5,258,816 | A | 11/1993 | Haneda et al. |
| 5,414,493 | A | 5/1995 | Fuji et al. |
| 5,444,515 | A | 8/1995 | Haneda et al. |

(Continued)

FOREIGN PATENT DOCUMENTS

| | | |
|---|---|---|
| EP | 1 331 525 | 7/2003 |
| EP | 1 273 980 | 8/2003 |

(Continued)

OTHER PUBLICATIONS

JP Office Action dtd Nov. 6, 2007, JP Appln. 2004-378082.

(Continued)

*Primary Examiner* — William J Royer
(74) *Attorney, Agent, or Firm* — Banner & Witcoff, Ltd.

(57) ABSTRACT

An image-forming device may include a main body, a developing unit, a transferring unit, and a tray. In some examples, the developing unit may include a developer-accommodating section that accommodates developer and a photosensitive member on which an electrostatic latent image is formed. The developing unit may further include a developer-carrying member to develop the electrostatic latent image. The tray may enable the developing unit to move between a contact position and a separate position.

8 Claims, 13 Drawing Sheets

U.S. PATENT DOCUMENTS

| | | | |
|---|---|---|---|
| 5,537,188 | A | 7/1996 | Haneda |
| 5,541,720 | A | 7/1996 | Haneda |
| 5,666,599 | A | 9/1997 | Miyasaka et al. |
| 5,758,232 | A | 5/1998 | Ikunami |
| 6,463,231 | B2 | 10/2002 | Numazu et al. |
| 6,647,227 | B2 | 11/2003 | Yokoi et al. |
| 6,647,228 | B2 | 11/2003 | Nakamura et al. |
| 6,697,586 | B2 | 2/2004 | Yamamoto et al. |
| 6,708,011 | B2 | 3/2004 | Nomura et al. |
| 6,721,521 | B2 | 4/2004 | Kataoka et al. |
| 6,738,591 | B2 | 5/2004 | Hattori et al. |
| 6,907,209 | B2 | 6/2005 | Abe |
| 6,978,103 | B2 | 12/2005 | Miura et al. |
| 7,274,894 | B2 | 9/2007 | Sato et al. |
| 7,447,467 | B2 | 11/2008 | Kamimura et al. |
| 7,715,752 | B2 | 5/2010 | Sakurai et al. |
| 7,720,413 | B2 | 5/2010 | Kamimura et al. |
| 8,064,793 | B2 | 11/2011 | Kamimura et al. |
| 2001/0019418 | A1 | 9/2001 | Kataoka et al. |
| 2003/0161656 | A1 | 8/2003 | Miura et al. |
| 2004/0022556 | A1 | 2/2004 | Nomura |
| 2004/0067081 | A1 | 4/2004 | Kasahara |
| 2004/0101327 | A1 | 5/2004 | Nomura et al. |
| 2004/0165910 | A1 | 8/2004 | Sato et al. |
| 2006/0140673 | A1 | 6/2006 | Kamimura et al. |
| 2006/0140674 | A1 | 6/2006 | Sato |
| 2010/0209140 | A1 | 8/2010 | Kamimura et al. |

FOREIGN PATENT DOCUMENTS

| | | | |
|---|---|---|---|
| JP | 02-165165 | A | 6/1990 |
| JP | 05-257340 | | 10/1993 |
| JP | 08-036346 | A | 2/1996 |
| JP | 08-054817 | A | 2/1996 |
| JP | 09-106471 | A | 6/1997 |
| JP | 09-269625 | A | 10/1997 |
| JP | 09-269716 | A | 10/1997 |
| JP | 10-307439 | | 11/1997 |
| JP | 10-149078 | A | 6/1998 |
| JP | 10-161421 | A | 6/1998 |
| JP | 11-84799 | | 3/1999 |
| JP | 2001-075449 | | 3/2001 |
| JP | 2001-125337 | | 5/2001 |
| JP | 2001-242763 | A | 9/2001 |
| JP | 2001-249517 | A | 9/2001 |
| JP | 2001-0272899 | | 10/2001 |
| JP | 2002-108049 | A | 4/2002 |
| JP | 2002-132011 | A | 5/2002 |
| JP | 2002-148898 | | 5/2002 |
| JP | 2002-214874 | A | 7/2002 |
| JP | 2002-268320 | A | 9/2002 |
| JP | 2002-297000 | A | 10/2002 |
| JP | 2003-015378 | A | 1/2003 |
| JP | 2003-015497 | A | 1/2003 |
| JP | 2003-107975 | A | 4/2003 |
| JP | 2003-241476 | | 8/2003 |
| JP | 2003-280491 | A | 10/2003 |
| JP | 2003-287992 | A | 10/2003 |
| JP | 2003-316104 | A | 11/2003 |
| JP | 2003-316105 | A | 11/2003 |
| JP | 2003-316233 | A | 11/2003 |
| JP | 2004-004183 | A | 1/2004 |
| JP | 2004-037889 | | 2/2004 |
| JP | 2004-061723 | A | 2/2004 |
| JP | 2004-066611 | A | 3/2004 |
| JP | 2004-109455 | A | 4/2004 |
| JP | 2004-109886 | | 4/2004 |
| JP | 2004-163579 | A | 6/2004 |
| JP | 2004-258138 | A | 9/2004 |
| JP | 2004-279937 | | 10/2004 |

OTHER PUBLICATIONS

EP Extended Search Report Apr. 19, 2006, EP Appln. 05028526.1.
US Office Action dtd Apr. 4, 2008, U.S. Appl. No. 11/316,951.
JP Office Action dtd May 13, 2008, JP Appln. 2004-378082.
Office Action from European Patent Office, dated Dec. 14, 2007.
Japanese Office Action mailed Nov. 20, 2007 in Application No. JP2004-378081 and English translation thereof.

IMAGE FORMING DEVICE HAVING GUIDE MECHANISM FOR GUIDING TRANSFERRING UNIT

CROSS REFERENCE TO RELATED APPLICATIONS

This application is a divisional of U.S. patent application Ser. No. 13/268,290, filed on Oct. 7, 2011, which is a divisional of U.S. patent application Ser. No. 12/768,347, filed on Apr. 27, 2010, now U.S. Pat. No. 8,064,793, which is a divisional of U.S. patent application Ser. No. 12/238,854, filed on Sep. 26, 2008, now U.S. Pat. No. 7,720,413, which is a divisional of U.S. patent application Ser. No. 11/316,946, filed on Dec. 27, 2005, now U.S. Pat. No. 7,447,467, which claims priority from Japanese Patent Application No. 2004-378081, filed on Dec. 27, 2004. The contents of the above noted applications are incorporated herein by reference in their entirety.

TECHNICAL FIELD

The disclosure relates to an image-forming device for forming images on a recording medium.

BACKGROUND

One type of image-forming device well known in the art has developing cartridges that can be detachably mounted in the image-forming device. This type of image-forming device, such as that disclosed in Japanese unexamined patent application publication No. 2001-272899, includes image-forming units, which have rollers such as photosensitive drums and which are removed from the body of the image-forming device in a direction parallel to the axes of these rollers.

In an image-forming device disclosed in United States patent application publication No. 2004/165910A1, a cover is positioned on the body of the image-forming device above the developing cartridges. The cover rotates about hinges in order to cover or expose the developing cartridges. When exposed, the developing cartridges can be removed from the image-forming device.

SUMMARY

However, since the plural rollers are pulled outward along the axial direction in the image-forming device disclosed in Japanese unexamined patent application publication No. 2001-272899, a large hole through which the rollers are withdrawn must be formed in the frame of the device. This hole makes it difficult to maintain the stiffness of the image-forming device.

Also, since developer is supplied downward from the developer-accommodating section in this image-forming device, there is a danger that developer will leak into the inside of the image-forming device.

Further, it is necessary to have the bearings or other members, used to hold and position each roller, recede from the shafts of the rollers. Accordingly, problems such as maintaining an accurate position of each roller arise.

Additionally, since the large hole is formed in one side wall of the frame that is located on the side of one longitudinal end of the shaft of each roller. Accordingly, the shaft of each roller is supported only at its other longitudinal end by the other side wall of the frame. It is therefore difficult to maintain the accurate position of each roller.

In the image-forming device described in United States patent application publication No. 2004/165910A1, it is possible to prevent leakage of developer to a degree since the developer is supplied upward from the developer-accommodating section. However, since the cover that is opened and closed when mounting and removing the developing cartridges is very large, it is difficult to securely fasten the cover on the device body (the portion of the body excluding the cover). In other words, the cover can easily shift in relation to the main body, which can weaken the stiffness of the image-forming device.

In view of the foregoing, it is an object of the invention to provide an image-forming device for forming images with developer that has a body with enhanced stiffness and that prevents developer from contaminating the interior of the device.

In order to attain the above and other objects, one or more aspects of the invention provides an image-forming device, including: a main body; a developing unit; a transferring unit; and a tray. The developing unit includes a photosensitive member, a developer-carrying member, and a developer-accommodating section. The transferring unit includes a pair of rollers and a belt. Electrostatic latent images are formed on a surface of the photosensitive member. The developer-accommodating section is positioned below the developer-carrying member and accommodates developer. The developer-carrying member is disposed below the photosensitive member and develops the electrostatic latent image formed on the photosensitive member into a visible image by supplying developer on to the photosensitive member. The transferring unit is disposed above the developing unit and transfers the visible images formed on the photosensitive member to a recording medium. The belt is supported by the pair of rollers and has a first surface extending in the predetermined direction and being capable of contacting the photosensitive member and a second surface located above the first surface. The tray is configured to enable the developing unit to move between a contact position and a separate position, the photosensitive member in the contact position being disposed below the belt and in contact with the belt, the photosensitive member in the separate position being disposed below the belt and being separate from the belt.

BRIEF DESCRIPTION OF THE DRAWINGS

Illustrative aspects in accordance with the invention will be described in detail with reference to the following figures wherein:

FIG. 5(*b*) is a cross-sectional view illustrating the photosensitive drum unit mounted in a photosensitive-drum-unit guide mechanism in the main body of the printer;

FIG. 5(*c*) is a side view of a right-side guide wall in the photosensitive-drum-unit guide mechanism seen from the left side thereof and illustrating male coupling members provided on the right-side guide wall;

FIG. 5(*d*) is a side view of a right-side wall of a frame in the photosensitive drum unit seen from the inner (left) side thereof and illustrating female coupling members and intermediate gears provided on the inner (left) side of the right-side wall;

FIG. 8(*b*) is another explanatory diagram illustrating the developing unit and the transfer unit mounted in the printer when the cleaning unit is detached from the transfer unit and the developing unit is at a location where the photosensitive drums in the developing unit are out of contact with the intermediate transfer belt in the transfer unit;

DETAILED DESCRIPTION

Figure 1:
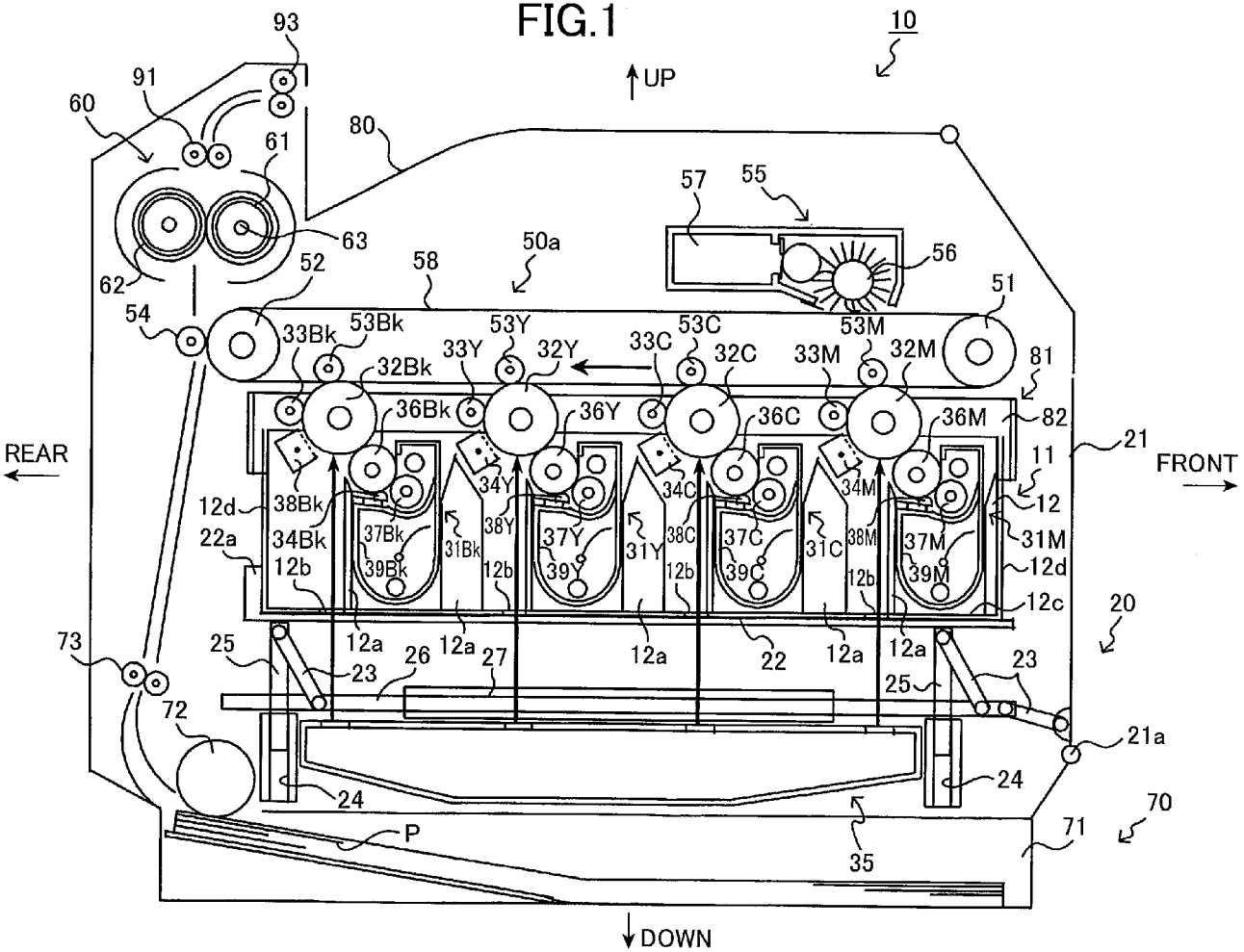
FIG. 1 is a side cross-sectional view of a printer according to an illustrative aspect of the invention.

An image-forming device according to some aspects of the invention will be described while referring to the accompanying drawings wherein like parts and components are designated by the same reference numerals to avoid duplicating description.

FIG. 1 is a side cross-sectional view of a printer 10 according to some aspects of the invention. As shown in FIG. 1, the printer 10 is a tandem color laser printer that includes a developing unit 11, a photosensitive drum unit 81, a lifting mechanism 20 for raising the developing unit 11, a transfer unit 50*a*, a fixing unit 60, a feeding unit 70, a discharge tray 80, and an exposing device 35.

In the following description, the expressions "front", "rear", "upper", "lower", "right", and "left" are used to define the various parts when the printer 10 is disposed in an orientation in which it is intended to be used. In this example, the side of the printer 10 on which a door 21 (to be described later) is provided will be referred to as the "front side" hereinafter. The right-to-left direction will be referred to also as the "widthwise direction" hereinafter.

Next, each of these components will be described in greater detail. First the developing unit 11 will be described.

The developing unit 11 includes a tray 12 functioning as a holder; and developer cartridges 31M, 31C, 31Y, and 31Bk for forming visible images with toner in each of the colors magenta (M), cyan (C), yellow (Y), and black (Bk), respectively. Hereinafter, components having reference numerals with letters appended to signify the color (e.g., M, C, Y, and Bk) will be collectively or generically referred to by the reference numeral alone (e.g., developer cartridges 31 or developer cartridge 31) unless referring to a specific color.

Each developer cartridge 31 includes a developer case 39 (39M, 39C, 39Y, and 39Bk) functioning as an outer casing of the developer cartridge 31 and accommodating toner therein.

Developing rollers 36 (36M, 36C, 36Y, and 36Bk) are provided in the respective developer cartridges 31 mounted in the developing unit 11. Each developing roller 36 is formed in a cylindrical shape with an electrically conductive silicone rubber as the base material, the surface of which is coated with a resin or a rubber material containing fluorine. However, the developing roller 36 need not be configured of a conductive silicone rubber as the base material, but may instead be configured of a conductive urethane rubber, for example. The average roughness (Rz) at ten points on the surface of the developing rollers 36 is set to 3-5 μm that is smaller than the average particle size of toner, which is 9 μm.

The developer cartridges 31 are also provided with supply rollers 37 (37M, 37C, 37Y, and 37Bk). Each supply roller 37 is formed of a conductive sponge roller and is configured to contact the respective developing roller 36 with pressure applied by the elastic force of the sponge. The supply roller 37 can be configured of an appropriate foam member formed of a conductive silicone rubber, EPDM, urethane rubber, or the like.

Each developer cartridge 31 also includes a thickness-regulating blade 38 (38M, 38C, 38Y, and 38Bk). The thickness-regulating blade 38 includes a base part that is plate-shaped and formed of stainless steel or the like and is fixed to a wall of the respective developer case 39, and a free end formed of an insulating silicone rubber or an insulating rubber or synthetic resin containing fluorine. The free end of each thickness-regulating blade 38 contacts the respective developing roller 36 from the lower side with pressure.

The developing rollers 36 described above are each provided above the respective developer case 39. Each developer case 39 has an opening 39*a* (FIG. 3) near the top through which toner is supplied externally to the developing roller 36.

The tray 12 is configured of a bottom wall 12*c* that is rectangular in shape, side walls 12*d* erected from peripheral edges of the bottom wall 12*c*, and a plurality of partitioning plates 12*a* dividing the internal space formed by the bottom wall 12*c* and side walls 12*d*.

Slits 12*b* are formed in the bottom wall 12*c* for each of the developer cartridges 31 so as not to block the paths of laser beams emitted from the exposing device 35 toward the photosensitive drum unit 81. The slits 12*b* are formed for each of the developer cartridges 31 at positions separated from the partitioning plates 12*a*. Components constituting the photosensitive drum unit 81 (specifically, photosensitive drums 32, chargers 34, and the like described later) are positioned above the respective slits 12*b*. This construction decreases the likelihood of toner falling through the slits 12*b*, thereby preventing toner from contaminating the interior of the printer 10 below the tray 12.

A U-shaped cutout part 12*e* (see FIG. 3) is formed in the side walls 12*d* for each of the developer cartridges 31. The developing rollers 36 are rotatably supported in the respective cutout parts 12*e* via support shafts 36*a* (see FIG. 2).

The developer cartridges 31 are mounted in the tray 12 by engaging the support shafts 36*a* of the developing rollers 36 in the respective cutout parts 12*e* and by bringing the periphery of the developer cartridges 31 into contact with the side walls 12*d* and the partitioning plates 12*a*. Thus, the developer cartridges 31 can be properly positioned in the tray 12, with the support shafts 36*a* extending horizontally in the widthwise (right-to-left) direction.

Next, the photosensitive drum unit 81 will be described in greater detail. The photosensitive drum unit 81 includes a frame 82 having a square or rectangular tube shape. Within the frame 82, the photosensitive drum unit 81 includes photosensitive drums 32 (32M, 32C, 32Y, and 32Bk), cleaning rollers 33 (33M, 33C, 33Y, and 33Bk), and chargers 34 (34M, 34C, 34Y, and 34Bk). Inverted U-shaped cutout parts 82*c* (see FIG. 2) are formed in the frame 82 corresponding to each of the developer cartridges 31. The cutout parts 82*c* can engage with the support shafts 36*a* of the developing rollers 36.

Each photosensitive drum 32 (organic photoconductors) mounted in the photosensitive drum unit 81 is formed, for example, of an aluminum hollow tube covered by a photosensitive layer with a positive charging nature. The photosensitive layer is formed at a thickness of 20 μm or greater. Further, the aluminum hollow tube is used as a grounding layer.

The cleaning rollers 33 are resilient rollers formed of an electrically conductive sponge or the like and are disposed in sliding contact with the lower sections of the photosensitive drums 32. Since the printer 10 employs a cleanerless developing method, residual toner that the cleaning rollers 33 remove from the photosensitive drums 32 is once again returned to the photosensitive drums 32 within a prescribed cycle after the developing process has been completed. The toner is then recovered by the developing rollers 36 and returned to the developer cartridges 31.

The chargers 34 are Scorotron-type charging devices. The chargers 34 confront, but do not contact, the surfaces of the respective photosensitive drums 32 from the bottom side thereof at a position downstream of the respective cleaning rollers 33 in the rotational direction of the photosensitive drums 32.

The exposing device 35 is configured of a laser scanning unit well known in the art. The exposing device 35 is disposed below and separated a prescribed distance from the developing unit 11, vertically overlapping the photosensitive drums 32 and chargers 34. The exposing device 35 irradiates laser beams on the surfaces of the photosensitive drums 32 at a position downstream of the chargers 34 in the rotational direction of the photosensitive drums 32. The exposing device 35 irradiates laser beams onto the surfaces of the photosensitive drums 32 based on image data in order to form electrostatic latent images for each color on the surfaces of the photosensitive drums 32.

When disposed below the developing unit 11 in this way, the exposing device 35 is less likely to be influenced by vibrations than when disposed in the top of the device.

With this construction, the supply rollers 37 supply positively charged toner to the respective developing rollers 36, and the respective thickness-regulating blades 38 maintain the toner carried on the developing rollers 36 at a uniform thin layer. Subsequently, positively charged electrostatic latent images formed on the photosensitive drums 32 can be developed with the positively charged toner according to the reverse developing method at the point of contact between the developing rollers 36 and the respective photosensitive drums 32, thereby forming an image of very high quality.

Next, the transfer unit 50*a* will be described in greater detail. The transfer unit 50*a* includes an intermediate transfer belt 58, drive rollers 51 and 52 about which the intermediate transfer belt 58 is looped and supported, and intermediate transfer rollers 53 (53M, 53C, 53Y, and 53Bk).

The intermediate transfer belt 58 is a conductive sheet manufactured of polycarbonate, polyimide, or the like and formed in a belt shape. The intermediate transfer belt 58 travels circularly in contact with each of the photosensitive drums 32. The intermediate transfer rollers 53 are disposed within the loop of the intermediate transfer belt 58 at positions opposing the respective photosensitive drums 32.

The intermediate transfer belt 58 is disposed such that the surface opposing the photosensitive drums 32 moves in a horizontal direction from the magenta developer cartridge 31M toward the black developer cartridge 31Bk.

A prescribed voltage is applied to the intermediate transfer rollers 53 in order to temporarily transfer a toner image formed on each of the photosensitive drums 32 onto the intermediate transfer belt 58. A secondary transfer roller 54 is disposed at a position in which the toner image is transferred onto a paper P, that is, opposite the drive roller 52, downstream of the photosensitive drums 32 with respect to the moving direction of the intermediate transfer belt 58 and on the surface of the intermediate transfer belt 58 that opposes the photosensitive drums 32. A prescribed potential is applied to the secondary transfer roller 54. As a result, a four-color toner image carried on the intermediate transfer belt 58 is transferred onto the paper P.

A cleaning unit 55 is disposed on the opposite side of the intermediate transfer belt 58 from the photosensitive drums 32. The cleaning unit 55 includes a scraping member 56, and a case 57. Toner remaining on the intermediate transfer belt 58 after the transfer operation is scraped off by the scraping member 56 and collected in the case 57.

Next, the fixing unit 60 will be described in greater detail. The fixing unit 60 includes a heating roller 61 and a pressure roller 62 that rotate in contact with each other. A heater 63 such as a halogen lamp is provided inside the heating roller 61 for emitting heat when electrified to raise the temperature of the heating roller 61. After a toner image has been transferred onto the paper P, the toner image is fixed to the paper P by heat and pressure as the paper P is pinched between and conveyed by the heating roller 61, heated to a fixing temperature of about 180° C. during the printing operation, and the pressure roller 62 that applies pressure to the heating roller 61.

The fixing unit 60 is not disposed on either the tray 12 or the photosensitive drum unit 81, but in the top section of the printer 10. Accordingly, the fixing unit 60 is not affected by movement of the tray 12 or photosensitive drum unit 81.

Next, the feeding unit 70 will be described in greater detail. The feeding unit 70 is disposed in the bottommost section of the printer 10 and includes a loading tray 71 for accommodating the paper P, and a pickup roller 72 for feeding the paper P. The feeding unit 70 is configured to feed the paper P at a prescribed timing in relation to an image-forming process performed by the exposing device 35, developer cartridges 31, photosensitive drums 32, and intermediate transfer belt 58. A pair of conveying rollers 73 disposed downstream of the pickup roller 72 in the feeding direction receive the paper P fed by the feeding unit 70 and convey the paper P to the point of contact (nip point) between the intermediate transfer belt 58 and the secondary transfer roller 54.

The discharge tray 80 is disposed on the discharge side of the fixing unit 60 for accommodating discharged sheets of paper P. Pairs of conveying rollers 91 and 93 disposed downstream of the fixing unit 60 receive the paper P and discharge the paper P onto the discharge tray 80.

Next, the lifting mechanism 20 will be described in greater detail. The lifting mechanism 20 includes a rotational shaft 21*a*, a door 21 that swings open and closed about the rotational shaft 21*a*, a support base 22 for supporting the developing unit 11, a plurality of lifting members 25 fixed directly beneath the support base 22, a plurality of lifting support members 24 that slidably support the lifting members 25, a horizontal moving member 26, a horizontal movement support member 27 for slidably supporting the horizontal moving member 26 in the horizontal direction, and linking members 23 connecting the door 21 to the horizontal moving member 26 and the horizontal moving member 26 to the lifting members 25.

An end wall 22*a* is provided on an end of the support base 22 (hereinafter referred to as the "rear end") opposite the end on which the door 21 is provided (hereinafter referred to as the "front end"). When the developing unit 11 is resting on the support base 22 in contact with the end wall 22*a* and the door 21 is rotated open or closed, the support base 22 is lifted or lowered, thereby allowing the developing unit 11 (the developing rollers 36) to be mounted on or detached from the photosensitive drums 32. The operations of the lifting mechanism 20 will be described in greater detail later.

Next, the operations of the printer 10 will be described in detail. First, the chargers 34 apply a uniform charge to the photosensitive layers on the surfaces of the respective photosensitive drums 32 as the photosensitive drums 32 are driven to rotate. Next, these photosensitive layers are exposed to the exposing device 35 based on image data for each of the colors magenta, cyan, yellow, and black. The developer cartridges 31 develop the latent images formed on the photosensitive surfaces of the respective photosensitive drums 32 in the colors magenta, cyan, yellow, and black, respectively, by depositing magenta toner, cyan toner, yellow toner, and black toner on the respective latent images. The toner images in magenta, cyan, yellow, and black formed on the photosensitive drums 32 in this way are temporarily transferred onto the surface of the intermediate transfer belt 58. The toner image for each color is formed at slightly different times with consideration for the velocity of the intermediate transfer belt 58 and the positions of the photosensitive drums 32 in order to transfer the toner images so that the toner images in each color are superimposed on the intermediate transfer belt 58. Any toner remaining on the photosensitive drums 32 after the transfer is temporarily retained by the respective cleaning rollers 33.

The four-color toner image formed on the intermediate transfer belt 58 as described above is transferred to the paper P fed from the feeding unit 70 at the nip point between the secondary transfer roller 54 and intermediate transfer belt 58. After the toner image is fixed to the paper P in the fixing unit 60, the paper P is discharged onto the discharge tray 80, thereby completing the formation of a four-color image.

Next, the operations of the lifting mechanism 20 will be described with reference to FIGS. 1 and 2.

When the door 21 is closed, as shown in FIG. 1, the support base 22 is raised upward. In other words, the horizontal moving member 26 is moved to the rear side, and the lifting members 25 are moved vertically upward by the linking members 23 connecting the lifting members 25 to the horizontal moving member 26. Accordingly, the support base 22 is also moved vertically upward.

In this state, that is, when the support base 22 is pushed upward, the support shafts 36*a* of the developing rollers 36 are engaged in the cutout parts 82*c* (see FIG. 2) formed in the frame 82. Hence, the developing unit 11 and the photosensitive drum unit 81 are positioned relative to each other. The position of the developing unit 11 at this time shown in FIG. 1 will be referred to as the "first accommodating position" hereinafter.

Figure 2:
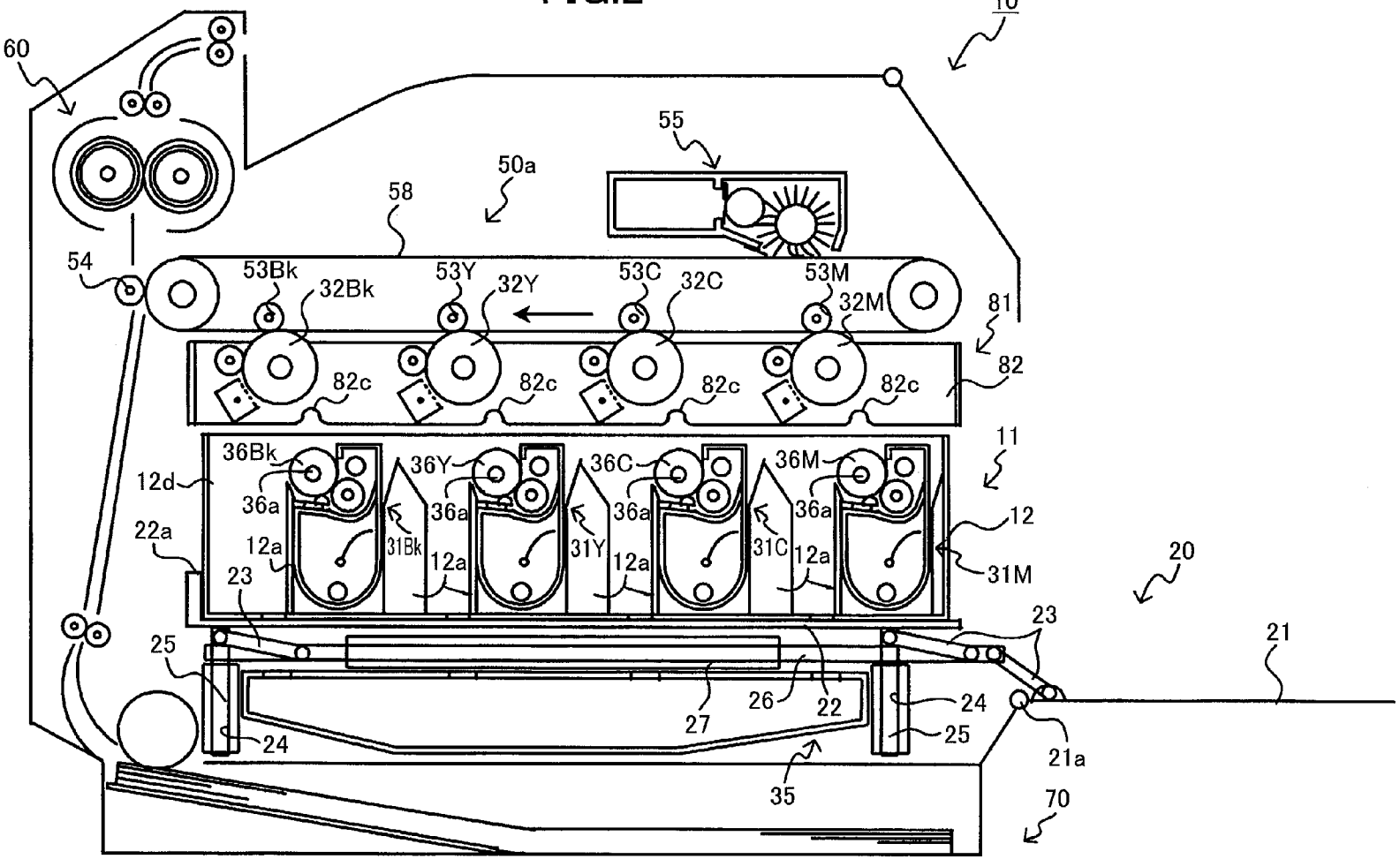
FIG. 2 is a side cross-sectional view of the printer when a door is open.

From this state, when the door 21 is opened as shown in FIG. 2, the support base 22 is pulled downward near the exposing device 35.

More specifically, the linking members 23 that move when the door 21 opens pull the horizontal moving member 26, moving the horizontal moving member 26 from the rear side toward the front side. By moving the horizontal moving member 26 to the front side, the lifting members 25 are moved vertically downward by the linking members 23.

As the developing unit 11 moves vertically downward along with the support base 22, the support shafts 36*a* of the developing rollers 36 disengage from the cutout parts 82*c* formed in the frame 82, enabling the developing unit 11 to be moved freely over the top surface of the support base 22. The position of the developing unit 11 at this time shown in FIG. 2 will be referred to as the "standby position" hereinafter. As a result, the developing unit 11 can be pulled in a substantially horizontal direction (forward direction) that is orthogonal to support shafts 32*a* to be described later, at which the photosensitive drums 32 are supported on the frame 82.

Next, the operation for removing the developing unit 11 and the photosensitive drum unit 81 will be described with reference to FIGS. 3 through 5(*c*).

Figure 3:
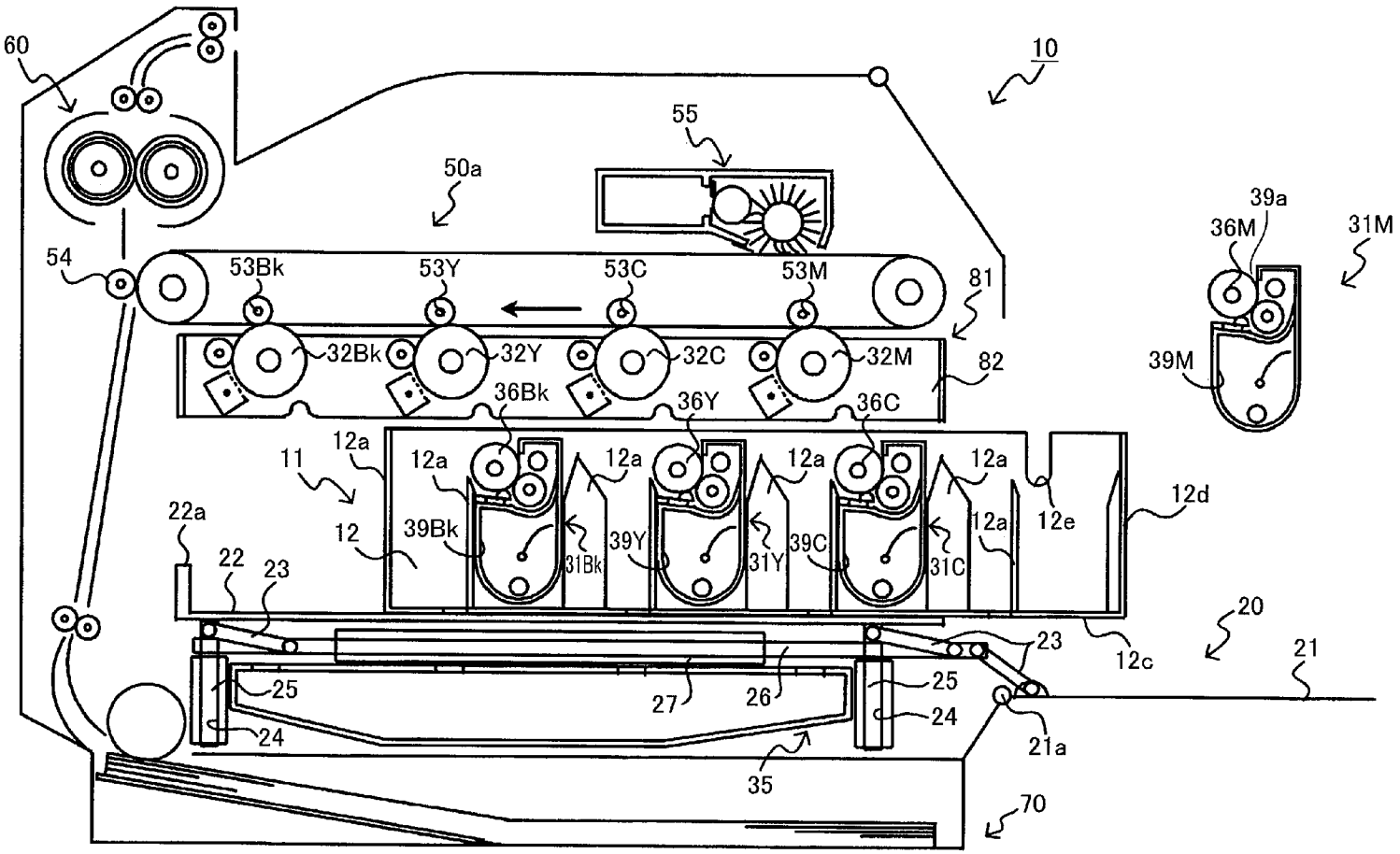
FIG. 3 is a side cross-sectional view of the printer showing the developing unit being pulled out.

As shown in FIG. 3, the developing unit 11 can be pulled part way from the body of the printer 10 so that only the magenta developer cartridge 31M or another developer cartridge 31 can be removed from the developing unit 11.

Figure 4:
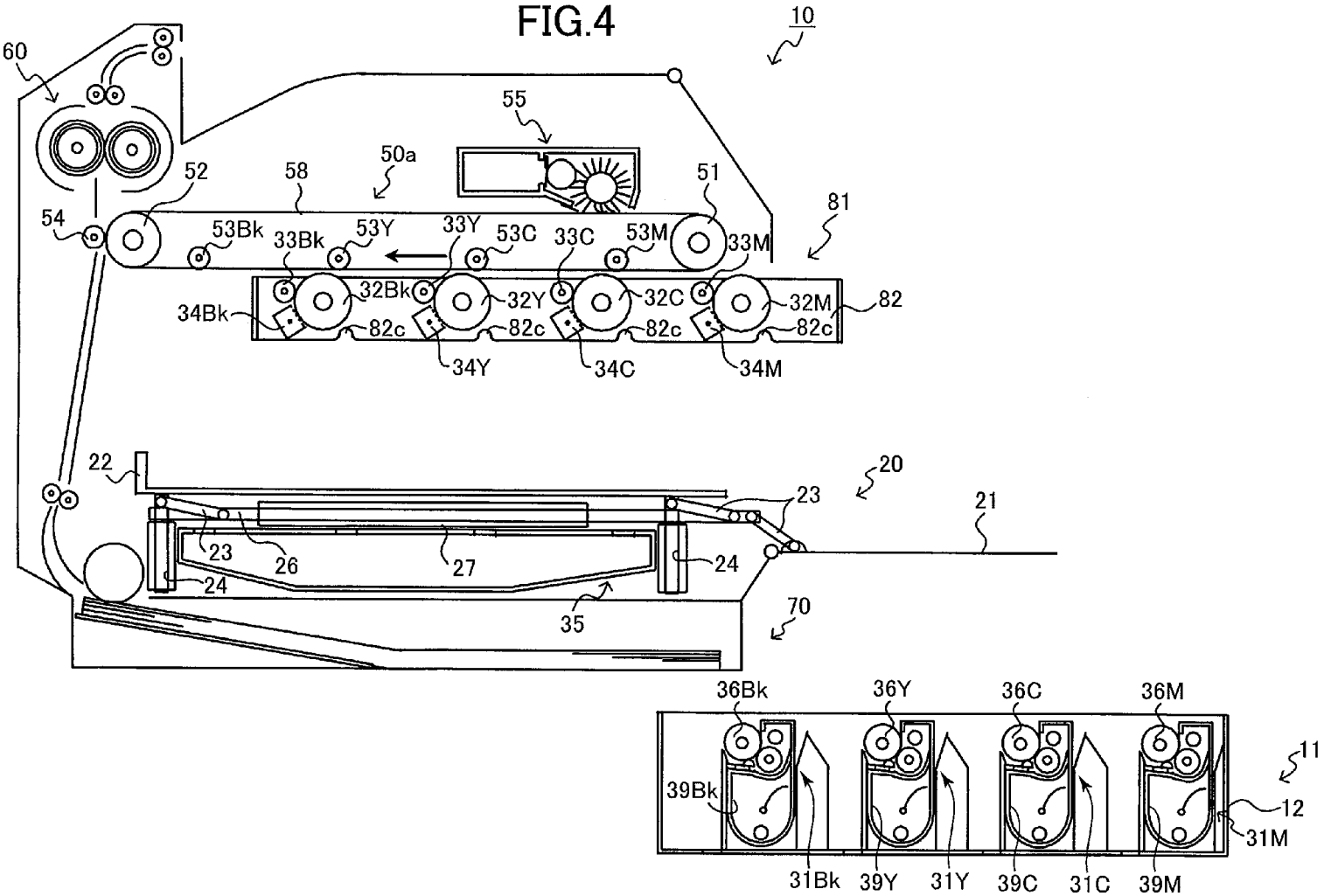
FIG. 4 is a side cross-sectional view of the printer showing a photosensitive drum unit being pulled out after the developing unit has been removed.
Figure 5A:
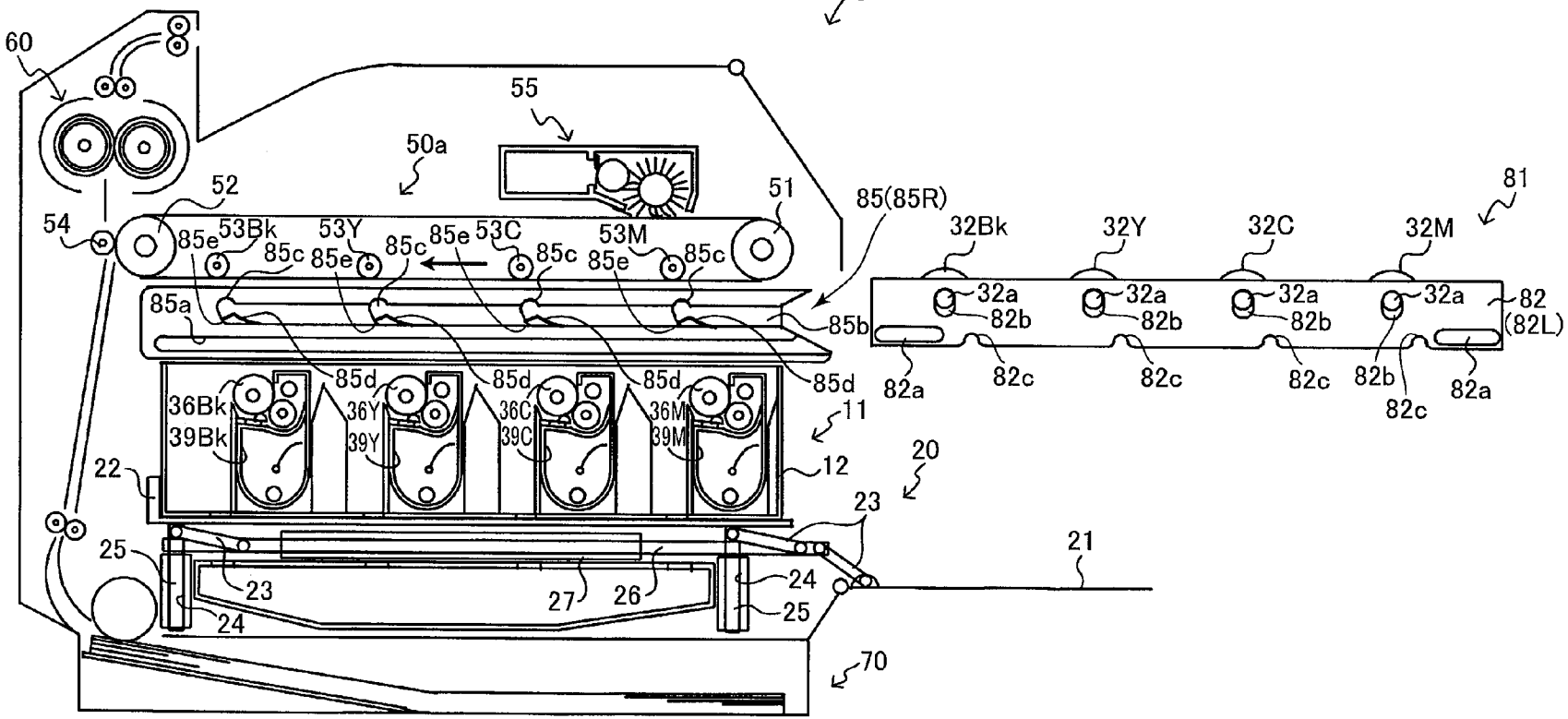
FIG. 5(*a*) is a side cross-sectional view of the printer showing the photosensitive drum unit being removed while the developing unit is still mounted.
Figure 5B:
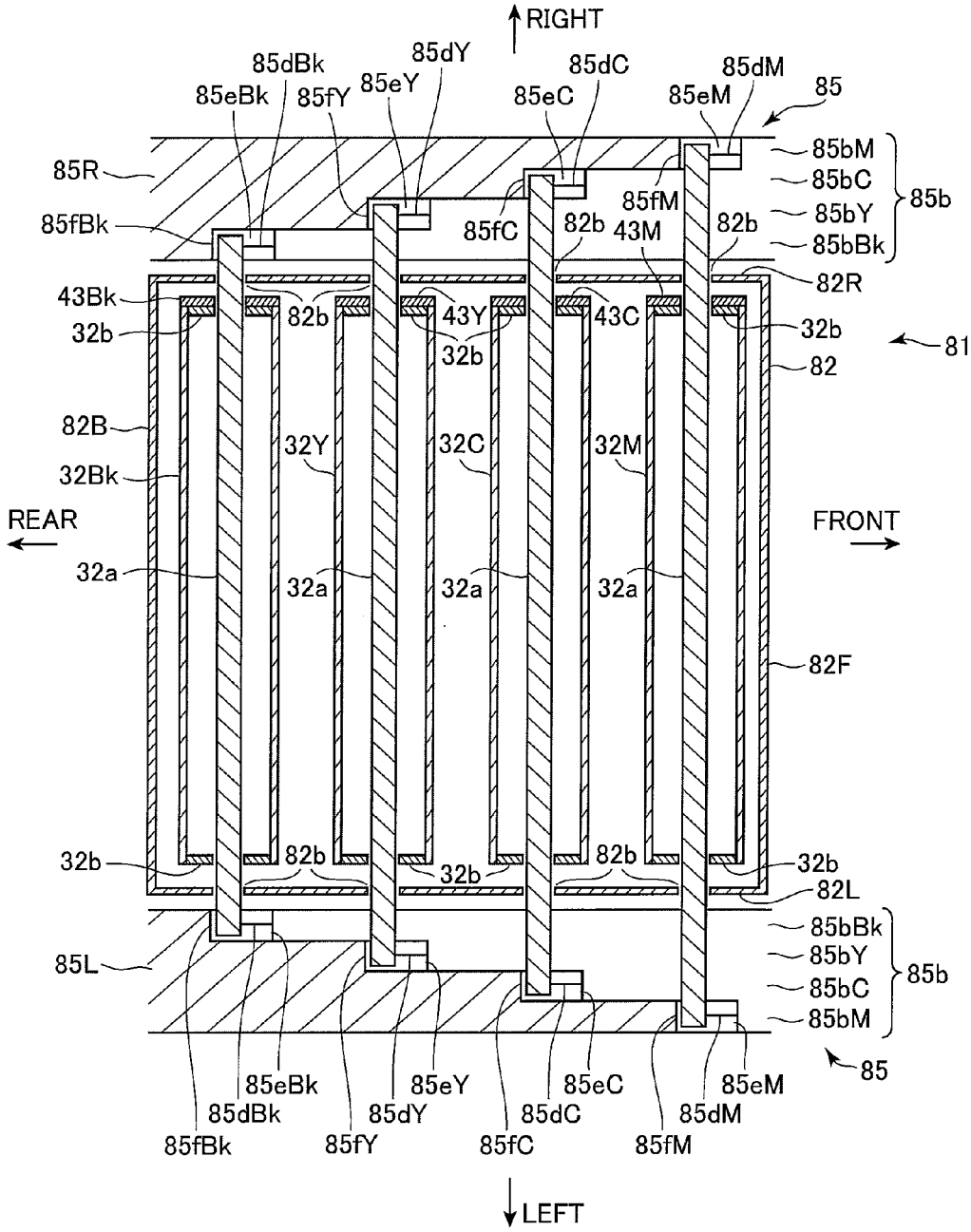
Figure 5C:
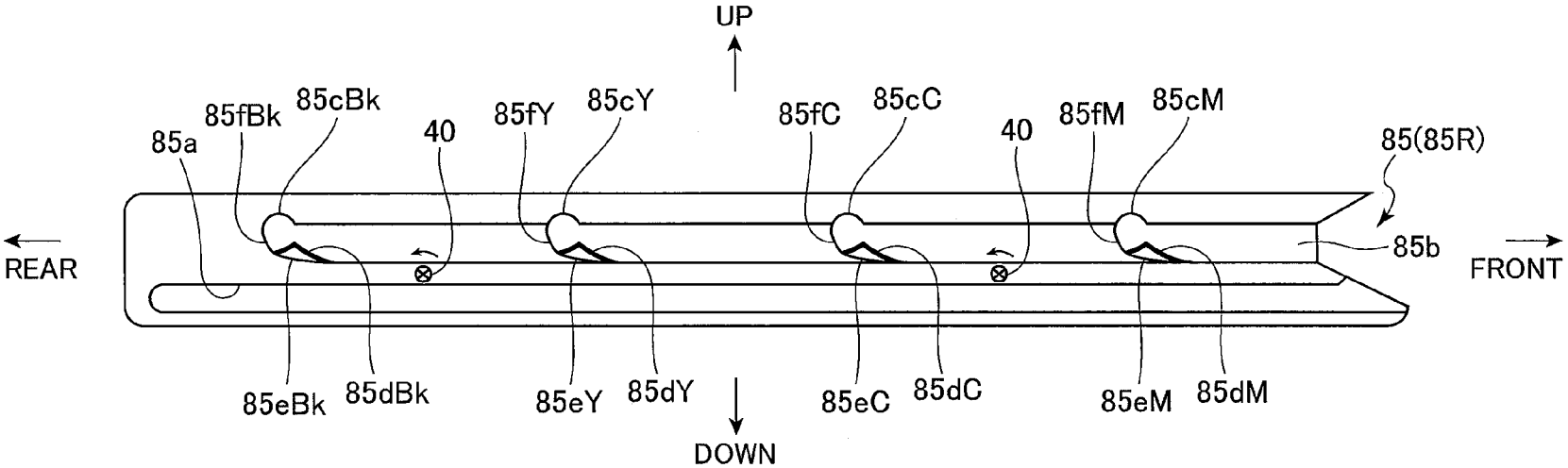
Figure 5D:
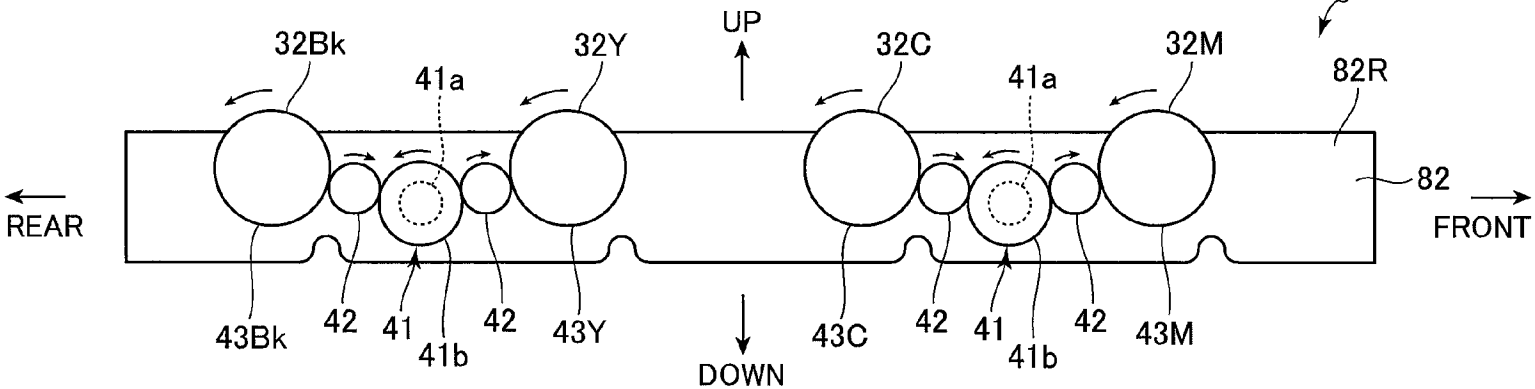

By continuing to pull the developing unit 11, the developing unit 11 can be entirely removed from the body of the printer 10, as shown in FIG. 4. The position of the developing unit 11 shown in FIG. 3 just before the developing unit 11 is pulled out completely from the printer 10 will be referred to as the "first removal position".

Even when the developing unit 11 is pulled out completely from the printer 10, the developer cartridges 31 still remain mounted in the developing unit 11 on the bottom wall 12*c* of the tray 12. Accordingly, the developing unit 11 can be placed nearly anywhere, including on a sloped or irregular surface.

As shown in FIG. 4 and FIG. 5(*a*), the photosensitive drum unit 81 can be pulled and removed from the body of the printer 10 in the same direction (removal direction or forward direction) in which the developing unit 11 is removed from the printer 10, after the developing unit 11 has been removed. The position of the photosensitive drum unit 81 shown in FIG. 1 when the photosensitive drum unit 81 is mounted in the printer 10 will be referred to as the "second accommodating position". The position of the photosensitive drum unit 81 shown in FIG. 4 just before the photosensitive drum unit 81 is pulled out completely from the printer 10 will be referred to as the "second removal position".

As shown in FIG. 5(*a*), the photosensitive drum unit 81 can be removed without first removing the developing unit 11. To accomplish this, a photosensitive-drum-unit guide mechanism 85 is provided in the body of the printer 10 for detachably fixing the photosensitive drum unit 81. Protruding parts are provided on the photosensitive drum unit 81 for engaging with the photosensitive-drum-unit guide mechanism 85.

More specifically, a plurality of protruding parts 82*a* is formed on the frame 82 of the photosensitive drum unit 81. The protruding parts 82*a* are elongated along the horizontal. Insertion through-holes 82*b* are also formed in the frame 82 corresponding to each of the photosensitive drums 32. The photosensitive drums 32 each have a support shaft 32*a* that inserts into the respective insertion through-holes 82*b*. When inserted into the insertion through-holes 82*b*, the support shafts 32*a* protrude slightly from the outer surfaces of the frame 82.

The photosensitive-drum-unit guide mechanism 85 includes first engaging grooves 85*a* for engaging with the plurality of protruding parts 82*a* formed on the frame 82, and second engaging grooves 85*b* for engaging with the support shafts 32*a* of the photosensitive drums 32.

The second engaging grooves 85*b* are provided with: engaging parts (indentations) 85*c* (85*c*M, 85*c*C, 85*c*Y, and 85*c*Bk) for engaging with the support shafts 32*a* of the photosensitive drums 32 (32M, 32C, 32Y, and 32Bk), respectively; and urging members (plate spring, for example) 85*d* (85*d*M, 85*d*C, 85*d*Y, and 85 dBk) for urging the support shafts 32*a* of the photosensitive drums 32 (32M, 32C, 32Y, and 32Bk) into the respective engaging parts 85*c* (85*c*M, 85*c*C, 85*c*Y, and 85*c*Bk) and for restricting the support shafts 32*a* from moving out therefrom.

The bottom of the second engaging grooves 85*b* are formed at a slant at slanted areas 85*e* (85*e*M, 85*e*C, 85*e*Y, and 85*e*Bk) near the engaging parts 85*c* (85*c*M, 85*c*C, 85*c*Y, and 85*c*Bk).

When mounting the photosensitive drum unit 81 into the body of the printer 10, the photosensitive drum unit 81 is inserted into the photosensitive-drum-unit guide mechanism 85 along the first engaging grooves 85*a* and second engaging grooves 85*b* and is fixed in position with the support shafts 32*a* of the photosensitive drums 32 contacting the engaging parts 85*c*. As a result, the photosensitive drums 32 are brought into contact with the intermediate transfer belt 58 as shown in FIG. 2. Thus, the support shafts 32*a* of the photosensitive drums 32 are properly positioned in the main body of the printer 10. The support shafts 32*a* extend horizontally in the widthwise (right-to-left) direction that is orthogonal to the forward direction, that is, the removal directions of the developing unit 11 and the photosensitive drum unit 81.

When removing the photosensitive drum unit 81 from the body of the printer 10, the pulling action applies a force opposing the urging force of the urging members 85*d*, so that the support shafts 32*a* separate from the engaging parts 85*c* and are pulled out along the second engaging grooves 85*b*. As a result, the frame 82 moves slightly downwardly and forwardly along the slanted areas 85*e* of the bottom surface of the second engaging grooves 85*b*, and the photosensitive drums 32 are brought out of contact with the intermediate transfer belt 58 as shown in FIG. 4.

More specifically, as shown in FIG. 5(*b*), the frame 82 has a right-side wall 82R, a left-side wall 82L, a front-side wall 82F, and a rear-side wall 82B. The insertion through-holes 82*b* are formed through each of the right-side wall 82R and the left-side wall 82L.

A pair of caps 32*b* are fitted to a pair of opposite axial ends (right-side and left-side axial ends) of each tube-shaped photosensitive drum 32. A drum gear 43 (43M, 43C, 43Y, or 43Bk) is attached to one axial end (right-side axial end) of each photosensitive drum 32 (32M, 32C, 32Y, or 32Bk). Each drum gear 43 is fixedly secured to the corresponding photosensitive drum 32, and is incapable of rotating relative to the photosensitive drum 32. In other words, each photosensitive drum 32 rotates together with the corresponding drum gear 43.

The rotational shaft 32*a* is provided to extend along the central axis of each photosensitive drum 32. The rotational shaft 32*a* extends rightwardly to pass through the cap 32*b* and the drum gear 43 at the right-side end of the photosensitive drum 32, and extends leftwardly to pass through the other cap 32*b* at the left-side end of the photosensitive drum 32. Thus, the rotational shaft 32*a* protrudes axially outwardly of the photosensitive drum 32 in the widthwise (right-to-left) direction. The photosensitive drum 32 is capable of rotating relative to the rotational shaft 32*a*.

Each photosensitive drum 32 is supported on the frame 82, with its rotational shaft 32*a* being inserted through the corresponding insertion through-hole 82*b*. As shown in FIG. 5(*b*), the support shafts 32*a* are inserted through the insertion through-holes 82*b* and protrude outwardly from the frame 82 in the widthwise direction, that is, protrude rightwardly from the right-side wall 82R and leftwardly from the left-side wall 82L. The protruding amounts of the support shafts 32*a* are different from one another. That is, the protruding amount of the support shaft 32*a* in the photosensitive drum 32Bk is the smallest, the protruding amount of the support shaft 32*a* in the photosensitive drum 32Y is the second smallest, the protruding amount of the support shaft 32*a* in the photosensitive drum 32C is the third smallest, and the protruding amount of the support shaft 32*a* in the photosensitive drum 32M is the largest.

The photosensitive-drum-unit guide mechanism 85 has a pair of guide walls (right-side guide wall 85R and a left-side guide wall 85L) that are distant from each other in the widthwise (right-to-left) direction. Each guide wall 85R, 85L includes the first engaging groove 85*a* (FIG. 5(*a*)) and the second engaging groove 85*b*. As shown in FIG. 5(*b*), the photosensitive drum unit 81 is mounted in the space between the pair of guide walls 85L and 85R, with the right-side wall 82R confronting the right-side guide wall 85R and the left-side wall 82L confronting the left-side guide wall 85L.

Each second engaging groove 85*b* has: a black-groove part 85*b*Bk for receiving the protruding support shaft 32*a* of the black photosensitive drum 32Bk; a yellow-groove part 85*b*Y for receiving the protruding support shaft 32*a* of the yellow photosensitive drum 32Y; a cyan-groove part 85*b*C for receiving the protruding support shaft 32*a* of the cyan photosensitive drum 32C; and a magenta-groove part 85*b*M for receiving the protruding support shaft 32*a* of the magenta photosensitive drum 32M.

The black-groove part 85*b*Bk, yellow-groove part 85*b*Y, cyan-groove part 85*b*C, and magenta-groove part 85*b*M are located as being shifted from one another in the widthwise (right-to-left) direction. That is, the black-groove part 85*b*Bk is on the innermost side, the yellow-groove part 85*b*Y is on the second innermost side, the cyan-groove part 85*b*C is on the third innermost side, and the magenta-groove part 85*b*M is on the outermost side.

In each guide wall 85R, 85L, the black-groove part 85*b*Bk, yellow-groove part 85*b*Y, cyan-groove part 85*b*C, and magenta-groove part 85*b*M extend rearwardly from the front end (not shown) of the guide wall 85R, 85L by the lengths that are different from one another. That is, the black-groove part 85*b*Bk extends the farthest, the yellow-groove part 85*b*Y extends the second farthest, the cyan-groove part 85*b*C extends the third farthest, and the magenta-groove part 85*b*M extends the shortest.

As shown in FIGS. 5(*b*) and 5(*c*), each guide wall 85R, 85L has: a black end wall 85*f*Bk at the farthest end of the black-groove part 85*b*Bk; an yellow end wall 85*f*Y at the farthest end of the yellow-groove part 85*b*Y; a cyan end wall 85*f*C at the farthest end of the cyan-groove part 85*b*C; and a magenta end wall 85*f*M at the farthest end of the magenta-groove part 85*b*M.

As shown in FIG. 5(*a*) and FIG. 5(*c*), each guide wall 85R, 85L has: the black engaging part 85*c*Bk on the top of the black-groove part 85*b*Bk near the black end wall 85*f*Bk; the yellow engaging part 85*c*Y on the top of the yellow-groove part 85*b*Y near the yellow end wall 85*f*Y; the cyan engaging part 85*c*C on the top of the cyan-groove part 85*b*C near the cyan end wall 85*f*C; and the magenta engaging part 85*c*M on the top of the magenta-groove part 85*b*M near the magenta end wall 85*f*M. The support shaft 32*a* of each photosensitive drum 32 (32Bk, 32Y, 32C, or 32M) is engaged in the corresponding engaging part 85*c* (85*c*Bk, 85*c*Y, 85*c*C, or 85*c*M).

As shown in FIG. 5(*b*) and FIG. 5(*c*), each guide wall 85R, 85L has: the black slanted area 85*e*Bk on the bottom of the black-groove part 85*b*Bk near the black end wall 85*f*Bk; the yellow slanted area 85*e*Y on the bottom of the yellow-groove part 85*b*Y near the yellow end wall 85*f*Y; the cyan slanted area 85*e*C. on the bottom of the cyan-groove part 85*b*C near the cyan end wall 85*f*C; and the magenta slanted area 85*e*M on the bottom of the magenta-groove part 85*b*M near the magenta end wall 85*f*M. In other words, the bottom surface of each groove part 85*b*Bk, 85*b*Y, 85*b*C, or 85*b*M gradually rises at the corresponding slanted area 85*e*Bk, 85*e*Y, 85*e*C, or 85*e*M to reach the corresponding end wall 85*f*Bk, 85*f*Y, 85*f*C, or 85*f*M.

As shown in FIG. 5(*b*) and FIG. 5(*c*), each guide wall 85R, 85L has: the black urging member 85 dBk on the bottom of the black-groove part 85*b*Bk at the black slanted area 85*e*Bk; the yellow urging member 85*d*Y on the bottom of the yellow-groove part 85*b*Y at the yellow slanted area 85*e*Y; the cyan urging member 85*d*C on the bottom of the cyan-groove part 85*b*C at the cyan slanted area 85*e*C; and the magenta urging member 85*d*M on the bottom of the magenta-groove part 85*b*M at the magenta slanted area 85*e*M. Each urging member 85*d* is a plate spring, in this example, for urging the support shaft 32*a* of the corresponding photosensitive drum 32 into the corresponding engaging part 85*c* and for restricting the support shaft 32*a* from moving out therefrom. Accordingly, both of the right-side and left-side ends (longitudinal ends) of the rotational shafts 32 that protrude out of the frame 82 are held in the engaging parts 85*c* by the urging members 85*d* on both of the right-side and left-side guide walls 85R and 85L in the main body (photosensitive-drum-unit-guide mechanism 85) of the printer 10.

As shown in FIG. 5(*d*), two female coupling members 41 are provided on the right-side wall 82R. Each female coupling member 41 is provided on the inner side of the frame 82, that is, on the left side of the right-side wall 82R. Each female coupling member 41 is rotatable about its rotational axis that extends in the widthwise (right-to-left) direction. Each female coupling member 41 has a receiving bore 41*a* that extends along the rotational axis of the female coupling member 41 and that is opened on the right-side axial end of the female coupling member 41. The open end of the receiving bore 41*a* is exposed outside of the frame 82 (right side of the right-side wall 82R) via a through-hole (not shown) that is formed through the right-side wall 82R. An outer gear 41*b* is formed on the outer periphery of a part of the female coupling member 41 that is on the inner side of the frame 82 (left side of the right-side wall 82R).

As shown in FIG. 5(*c*), two male coupling members 40 are provided on the right-side guide wall 85R. Each male coupling member 40 is rotatable about its rotational axis that extends in the widthwise (right-to-left) direction. Although not shown, a motor is provided in the body of the printer 10 on the outer side of the photosensitive-drum-unit guide mechanism 85, that is, on the right side of the right-side guide wall 85R. The male coupling members 40 are connected to the motor. The male coupling members 40 can therefore be driven by the motor to rotate about its rotational axis.

When the photosensitive drum unit 81 is mounted in the photosensitive-drum-unit guide mechanism 85, the male coupling members 40 move to protrude inwardly in the widthwise direction from the photosensitive-drum-unit guide mechanism 85. That is, the male coupling members 40 move to protrude leftwardly from the right-side guide wall 85R. The male coupling members 40 are inserted into the receiving bores 41*a* of the female coupling members 41. As a result, the male coupling members 40 are engaged with the female coupling members 41. It is noted that the male coupling members 40 are retracted from the female coupling members 41, while the photosensitive drum unit 81 is moving relative to the photosensitive-drum-unit guide mechanism 85 so as to be mounted in or removed from the photosensitive-drum-unit guide mechanism 85.

As shown in FIG. 5(*b*) and FIG. 5(*d*), the drum gears 43 (43Bk, 43Y, 43C, and 43M), which are provided on the right-side axial ends of the photosensitive drums 32 (32Bk, 32Y, 32C, and 32M), are located on the inside of the frame 82, that is, on the left side of the right-side wall 82R. As shown in FIG. 5(*d*), four intermediate gears 42 are provided on the inner side of the frame 82, that is, on the left side of the right-side wall 82R. Each intermediate gear 42 is in engagement with the outer gear 41*b* of one female coupling member 41 and one drum gear 43 that sandwich the subject intermediate gear 42 therebetween. Accordingly, when the photosensitive drum unit 81 is mounted in the photosensitive-drum-unit guide mechanism 85, the power is transmitted from the motor in the body of the printer 10 through the male coupling members 40, the female coupling members 41, the intermediate gears 42, and the drum gears 43 to the photosensitive drums 32. Accordingly, the photosensitive drums 32 can be driven to rotate.

The printer 10 having the construction described above is provided in the body thereof with: the exposing device 35 that forms electrostatic latent images on the surfaces of the photosensitive drums 32; the plurality of developer cartridges 31 that have the developer cases 39 accommodating toner and having openings formed on the top side and that have developing rollers 36 disposed near the openings in the developer cases 39 and developing latent images formed by the exposing device 35 into visible images by supplying toner from the developer cases 39 onto the photosensitive drums 32; and the secondary transfer roller 54 and intermediate transfer rollers 53 for transferring the visible images formed on the photosensitive drums 32 onto a recording medium. The printer 10 also includes the tray 12 that is accommodated at the first accommodating position in the body of the printer 10 independent of the photosensitive drums 32. The tray 12 retains the plurality of the developer cartridges 31 arranged in a row in the removal direction that is orthogonal to the support shafts 32*a* of the photosensitive drums 32 and is substantially horizontal. The tray 12 can be pulled from the first accommodating position to the first removal position in the substantially horizontal removal direction orthogonal to the support shafts 32*a*.

This construction maintains the rigidity of the printer 10 and prevents the interior of the printer 10 from being contaminated with toner. The construction also facilitates movement of the tray 12.

The construction also ensures accuracy in positioning the components of the printer 10, and particularly the support shafts 32*a* for the photosensitive drums 32.

For example, if the printer 10 were configured so that the rollers, such as the photosensitive drums 32 and the developing rollers 36, are withdrawn along the axial direction thereof, it would be difficult to reliably fix the support shafts of the rollers when mounted in the printer 10. The support shafts of the rollers would tend to wobble and to become out of the right positions. However, since the printer 10 is configured so that the developing rollers 36 are removed as a single unit in a substantially horizontal direction orthogonal to the axial direction of the developing rollers 36 and the photosensitive drums 32 are removed as a single unit in a substantially horizontal direction orthogonal to the axial direction of the photosensitive drums 32, it is possible to prevent wobble in the support shafts of the rollers. It is possible to bring the support shafts in the right positions.

Because the photosensitive drums 32 are removed as a single unit in the forward direction that is orthogonal to the axial direction of the photosensitive drums 32 (right-to-left direction), it is unnecessary to form openings in either side (right-side or left-side) of the main body that are located on the longitudinal ends of the support shafts 32*a*. Accordingly, the main body of the printer 10 can support the support shafts 32*a* on both longitudinal ends thereof. That is, the photosensitive-drum-unit guide mechanism 85 can support the support shafts 32*a* at their right and left ends by both of the right-side and left-side guide walls 85R and 85L, respectively. This construction ensures that the support shafts 32*a* are located in the right positions. While being supported by the right and left side walls 82R and 82L of the frame 82, the photosensitive drums 32 can be easily removed from the printer 10 in the direction that is orthogonal to the axial direction of the support shafts 32*a*.

The bottom of the second engaging grooves 85*b* are formed at a slant at the slanted areas 85*e* (85*e*M, 85*e*C, 85*e*Y, and 85*e*Bk) near the engaging parts 85*c* (85*c*M, 85*c*C, 85*c*Y, and 85*c*Bk) so that the photosensitive drums 32 are not damaged by sliding against the intermediate transfer belt 58 when removing the photosensitive drum unit 81. In other words, the second engaging grooves 85*b* are configured so that the photosensitive drums 32 will not contact the transfer unit 50*a* (intermediate transfer belt 58) until the support shafts 32*a* arrive in the engaging parts 85*c*.

The printer 10 is configured so that the developer cartridges 31 can be pulled out while the photosensitive drums 32 and the exposing device 35 remain in the main body of the printer 10. Accordingly, the weight of the portion being removed can be lessened, preventing the printer 10 from falling over. Further, by reducing the number of components that are removed, the size of the opening in the body of the printer 10 through which the components are removed (the size of the opening formed in the frame of the printer 10 by opening the cover 21) can be reduced, making the printer 10 rigid.

Further, the tray 12 can be moved by the moving mechanism constructed from the linking members 23, lifting support members 24, lifting members 25, and horizontal moving member 26 between the first accommodating position (FIG. 1) and the standby position (FIG. 2) that is located between the first accommodating position and the first removal position (FIG. 3). This construction facilitates movement of the tray 12.

It is noted that an operation for accommodating the tray 12 in the first accommodating position or removing the tray 12 from the first accommodating position requires a relatively large amount of force, in order to fixedly secure the developing unit 11 relative to the main body of the printer 10 and in order to accurately position the developing unit 11 relative to the main body of the printer 10. When moving the tray 12, this operation for accommodating the tray 12 in the first accommodating position or removing the tray 12 from the first accommodating position is performed using the moving mechanism constructed from the linking members 23, lifting support members 24, lifting members 25, and horizontal moving member 26. Accordingly, the printer 10 facilitates movement of the tray 12.

Further, the first accommodating position (FIG. 1) and the standby position (FIG. 2) are separate from each other vertically and are both positioned between the photosensitive drums 32 and the exposing device 35. Hence, when moving the tray 12 from the first accommodating position to the standby position, the tray 12 can easily be moved vertically by using the support base 22, linking members 23, lifting support members 24, lifting members 25, and horizontal moving member 26.

Further, the tray 12 is capable of sliding over the top surface of the support base 22 so that the tray 12 can be moved between the first accommodating position and the first removal position over the top surface of the support base 22. Hence, the tray 12 can be moved along the support base 22, allowing for smooth movement of the tray 12.

The printer 10 includes the door 21 positioned on the path of the tray 12 that moves over the support base 22, and is capable of moving the tray 12 from the first accommodating position (FIG. 1) to the first removal position (FIG. 3) when the door 21 is opened. The printer 10 includes the lifting mechanism 20 that moves the tray 12 from the first accommodating position to the standby position by driving the support base 22 when the door 21 is changed from a closed state to an open state, and moves the tray 12 from the standby position back to the first accommodating position by raising the support base 22 when the door 21 is changed from the open state to the closed state. With this construction, the support base 22 is driven in association with movement of the door 21, thereby efficiently moving the tray 12. Further, the support base 22 is configured so that the tray 12 can be separated from the body of the printer 10 after being moved to the first removal position.

The printer 10 also includes: the frame 82 that retains the photosensitive drums 32 and that is accommodated at the second accommodating position (FIG. 1) in the main body; and the photosensitive-drum-unit guide mechanism 85 for moving the frame 82 between the second accommodating position and the second removal position (FIG. 4) that is separate from the second accommodating position in the removal direction, which is substantially horizontal.

With this construction, both the developer cartridges 31 and the photosensitive drums 32 can be easily removed from the body of the printer 10.

The direction for removing the developing unit 11 and the direction for removing the photosensitive drum unit 81 are the same direction. Since both the tray 12 and the frame 82 can be removed from the printer 10 in the same direction, space need only be allocated on one side of the printer 10 when considering installation locations, facilitating installation of the printer 10.

The tray 12 includes the plurality of partitioning plates 12*a* and side walls 12*d* for detachably holding the developer cartridges 31. Each of the developer cartridges 31 has peripheral parts that engage with the partitioning plates 12*a* and side walls 12*d*. Hence, the developer cartridges 31 can be mounted in or removed from the tray 12, enabling the developer cartridges 31 to be individually replaced. As a result, the running cost of the printer 10 can be decreased.

Further, the support base 22 is configured so that the tray 12 can be separated from the body of the printer 10 after being moved to the first removal position. Hence, by removing the tray 12 from the printer 10, cleaning or other maintenance can easily be performed on the tray 12 and the interior of the printer 10.

Further, the developer cases 39 have openings formed on the top side for supplying toner externally, and the developing rollers 36 are disposed near the openings of the respective developer cases 39. The tray 12 has a box shape constructed of the bottom wall 12*c* and the side walls 12*d* erected on the periphery of the bottom wall 12*c*. Thus providing the bottom wall 12*c* on the tray 12 strengthens the tray 12. Further, any toner that may spill from the developer cartridges 31 is collected on the bottom wall 12*c*, thereby preventing toner from contaminating the interior of the printer 10.

The developing rollers 36 have support shafts 36*a* for positioning, and the side walls 12*d* of the tray 12 include cutout parts 12*e* that engage with these support shafts 36*a*. Hence, by disposing the developing rollers 36 near the top edge of the tray 12, the cutout part 12*e* retaining the support shafts 36*a* can be made shallower, thereby preventing a decline in the strength of the tray 12.

By improving the stiffness of the printer 10, as described above, it is possible to restrain vibrations during image formation. Accordingly, the construction described above prevents toner from falling into the interior of the printer 10 due to such vibrations.

The developer is transferred upward from the developing unit 11 onto the intermediate transfer belt 58, and then is transferred from the intermediate transfer belt 58 to the recording medium. The recording medium is prevented from falling. The developer transferred onto the intermediate transfer belt 58 is prevented from falling into the printer 10.

In the printer 10, each of the developing unit 11 and the photosensitive drum unit 81 can be removed from the printer 10 after being withdrawn to the prescribed position (first and second removal position). However, the units may be configured more like a desk drawer. In other words, an engaging part can be provided for temporarily stopping the unit when the unit is withdrawn to the prescribed position (first removal position). From this position, the front of the unit is lifted upward, allowing the unit to pass over the engaging part so that the unit can be removed from the body of the printer 10.

Further, in the printer 10, a visible image is temporarily transferred from the photosensitive drums 32 onto the intermediate transfer belt 58 and subsequently transferred from the intermediate transfer belt 58 to a recording medium. However, the visible image may instead be transferred directly from the photosensitive drums 32 onto the recording medium.

Further, the support base 22 is configured so that the tray 12 can be separated from the body of the printer 10 after being moved to the first removal position. However, the support base 22 may instead be configured to support the tray 12 without allowing the tray 12 to be separated from the body of the printer 10.

Figure 6:
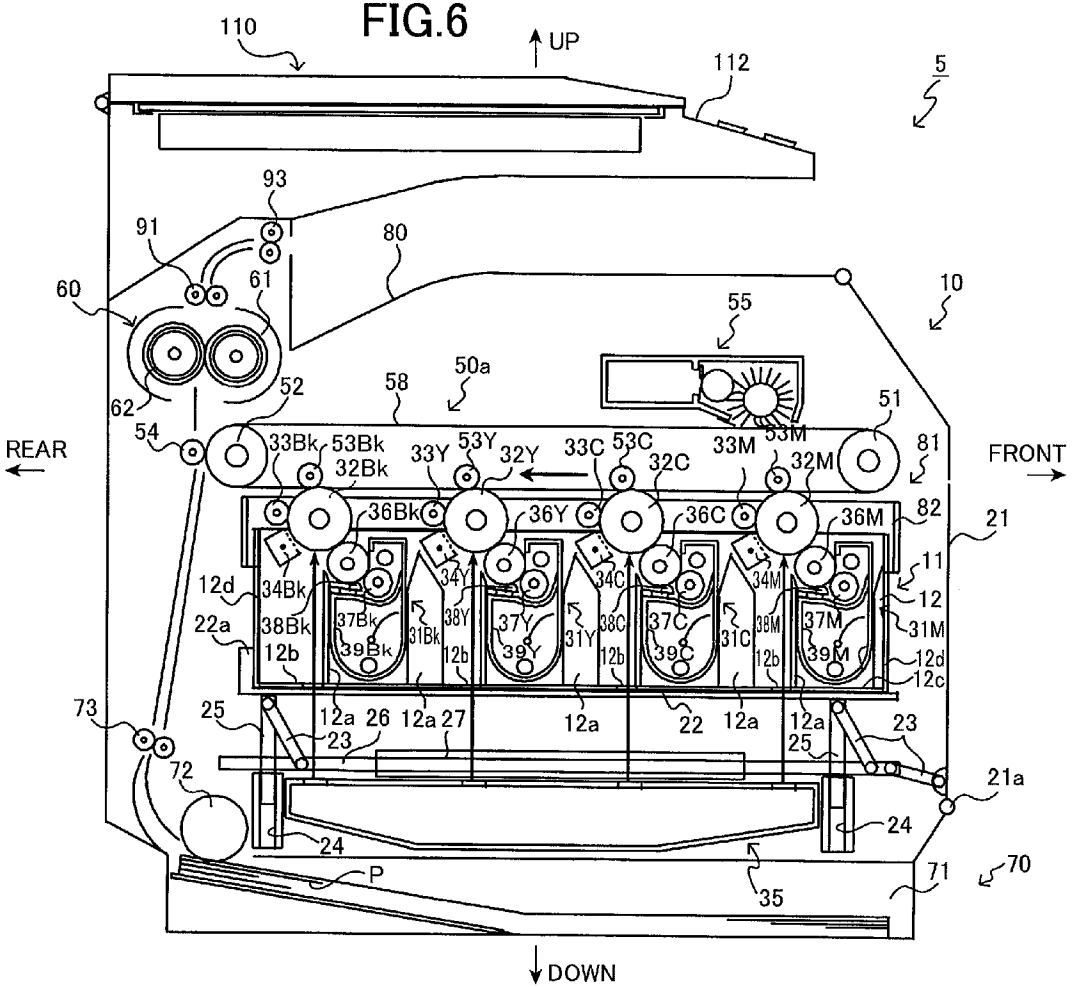
FIG. 6 is a side cross-sectional view showing a variation of the printer (multifunction device) according to the above-described aspect.

Further, the printer 10 is provided only with an image-forming function, but may be configured as a multifunction device 5, such as that shown in FIG. 6. In addition to the printer 10, this multifunction device 5 is provided with a scanner 110 disposed above the printer 10.

The multifunction device 5 reads images from a document with the scanner 110, the exposing device 35 forms electrostatic latent images on the photosensitive drums 32 based on the image data generated by the scanner 110, the developing unit 11 develops the electrostatic latent images into visible images, and the transfer unit 50*a* transfers the visible images onto a recording medium.

As shown in FIG. 6, the discharge tray 80 of the multifunction device 5 is disposed between the scanner 110 and the printer 10. Since the multifunction device 5 has a low center of gravity with the developer cartridges 31 arranged horizontally, the printer 10 remains stable even when providing the scanner 110 above the printer 10. Since the multifunction device 5 must have high rigidity when providing the scanner 110 on the top in this way, the structure described above for improving the rigidity of the printer 10 can maintain the overall rigidity of the multifunction device 5 when the scanner 110 is disposed on the top in this way. Further, by positioning the scanner 110 on the top, neither the tray 12 nor the photosensitive drum unit 81 conflicts with the scanner 110 when removed from the printer 10. In other words, since the scanner 110 does not interfere with the removal of the tray 12 or the photosensitive drum unit 81, there is no need to move the scanner 110 in order to remove the tray 12 or the photosensitive drum unit 81.

Further, since the discharge tray 80 is disposed between the body of the printer 10 and the scanner 110, the overall height of the multifunction device 5 can be lower than when the discharge tray 80 is provided above the scanner 110. Further, since the discharge tray 80 does not protrude from the device, the amount of space occupied by the device can be reduced.

Further, a control panel 112 can be disposed near the scanner 110 and may be provided with operating parts 114 that can be operated by the user. The multifunction device 5 configured in this way is more user-friendly than a conceivable device that provides the control panel 112 on the outer wall of the printer 10.

Next, a printer 15 according to another aspect of the invention will be described, wherein like parts and components are designated with the same reference numerals to avoid duplicating description. Only areas of the printer 15 that differ from the printer 10 described above will be described below.

The printer 15 will be described with reference to FIG. 7 through FIG. 11.

The printer 15 includes: a first door 21*b* that corresponds to the door 21 in the above-described printer 10 and that is used for removing the tray 12; and a second door 21*c* that is positioned above the first door 21*b* and that is for removing a transfer unit 50*b*.

Figure 10:
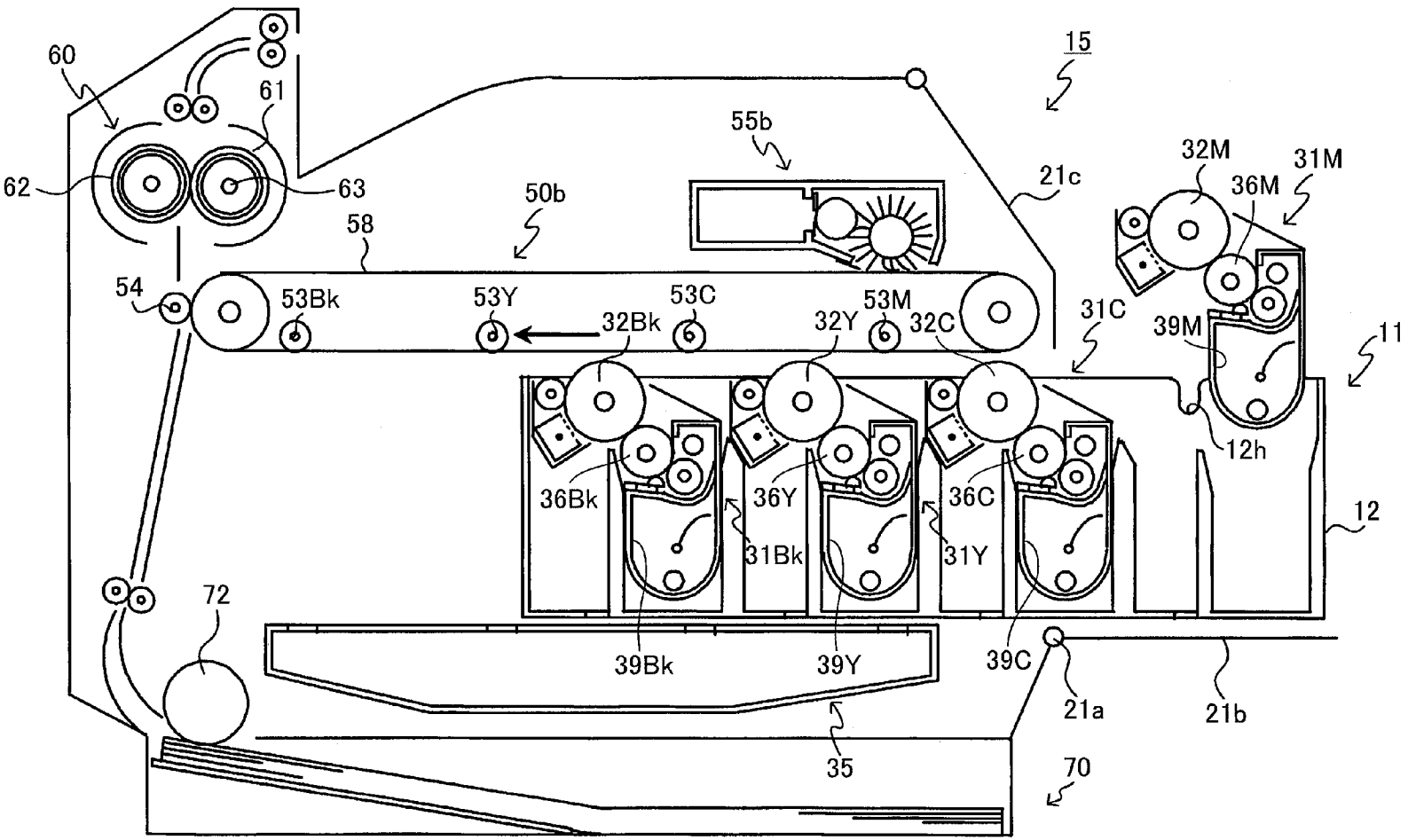
FIG. 10 is a side cross-sectional view of the printer when the developing unit is being removed.

Further, though the above-described printer 10 includes the photosensitive drum unit 81, the printer 15 does not include the photosensitive drum unit 81. Though the photosensitive drums 32, cleaning rollers 33, and chargers 34 are provided in the photosensitive drum unit 81 in the printer 10, the photosensitive drums 32, cleaning rollers 33, and chargers 34 are provided in the developer cartridge 31 together with the developing rollers 36 and the supply rollers 37 as shown in FIG. 10. Thus, the photosensitive drums 32 are disposed near the developing rollers 36. Inverted U-shaped cutout parts 12*h* are formed in the tray 12 for engaging with the support shafts 32*a* of the photosensitive drums 32, as shown in FIG. 8(*a*).

Figure 7:
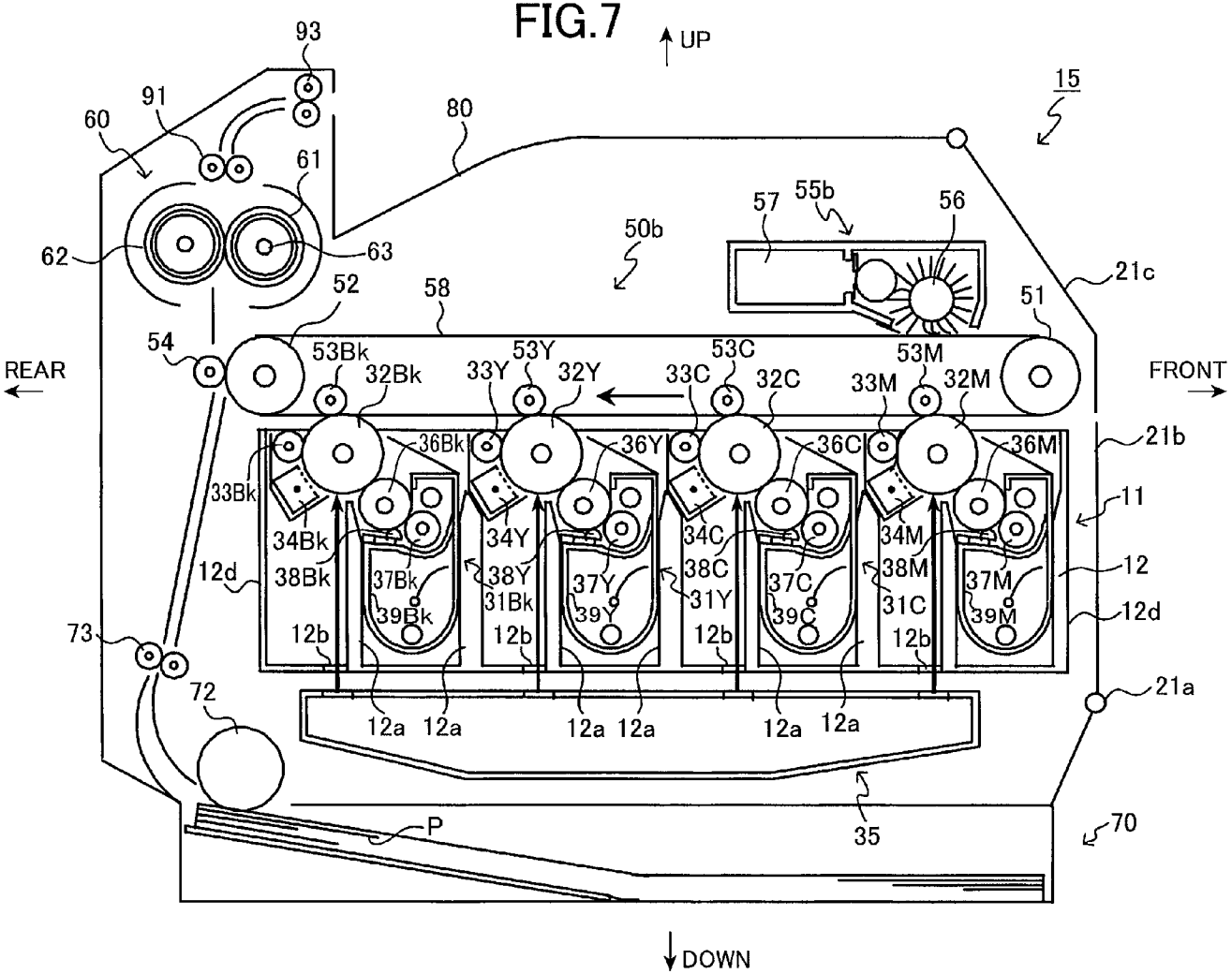
FIG. 7 is a side cross-sectional view of a printer according to another illustrative aspect of the invention.
Figure 8A:
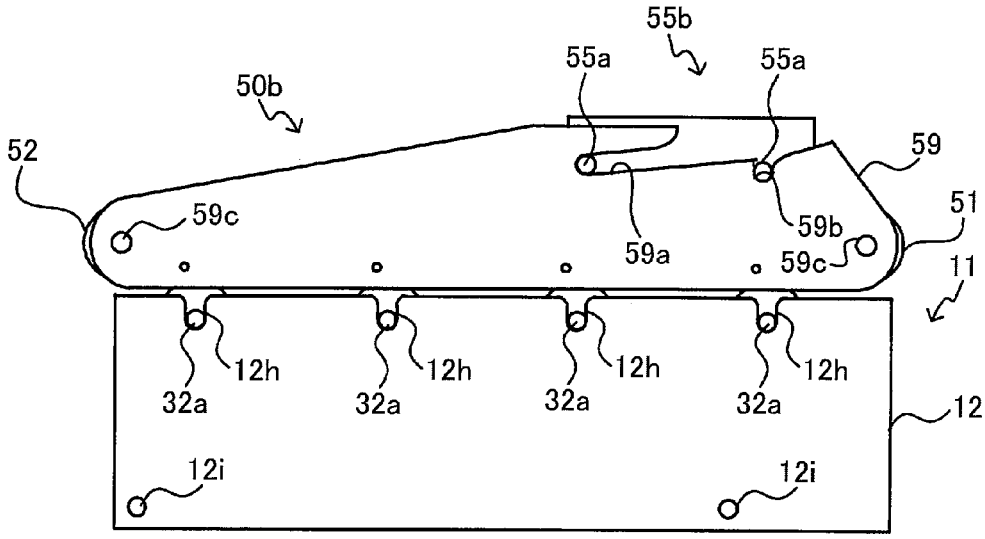
FIG. 8(*a*) is an explanatory diagram illustrating a developing unit and a transfer unit mounted in the printer when a cleaning unit is attached to the transfer unit and the developing unit is at a location where photosensitive drums in the developing unit are in contact with an intermediate transfer belt in the transfer unit.
Figure 8B:
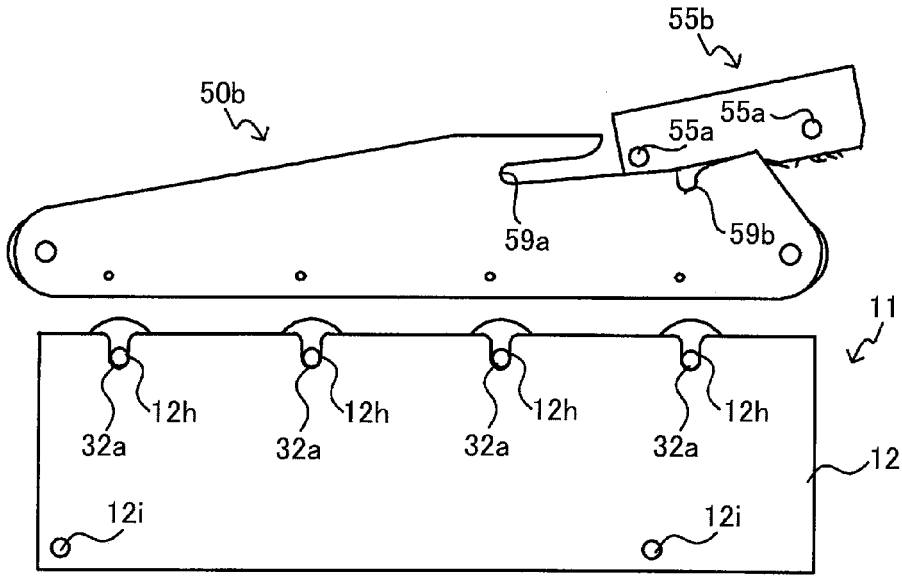

As illustrated in FIG. 7, FIG. 8(*a*), and FIG. 10, the developer cartridges 31 are fixed in a prescribed position by engaging the support shafts 32*a* of the photosensitive drums 32 in the cutout parts 12*h* and placing the outer periphery of the developer cartridges 31 in contact with the side walls 12*d* and partitioning plates 12*a*. Hence, by using the support shafts 32*a* of the photosensitive drums 32 nearest the top ends of the tray 12 to position the developer cartridges 31 with relation to the tray 12, the cutout parts 12*h* formed in the tray 12 can be made shallow.

More specifically, the photosensitive drums 32 have support shafts 32*a* for positioning, and the side walls 12*d* of the tray 12 include cutout parts 12*h* that engage with these support shafts 32*a*. Hence, by disposing the photosensitive drums 32 and developing rollers 36 near the top edge of the tray 12, the cutout part 12*h* retaining the support shafts 32*a* can be made shallower, thereby preventing a decline in the strength of the tray 12.

As shown in FIG. 8(*a*), the tray 12 also has protruding parts 12*i* that can engage with first engaging grooves 87*a* (FIG. 9) described later.

The printer 15 also has the transfer unit 50*b* in place of the above-described transfer unit 50*a* of the printer 10. As shown in FIG. 8(*a*), the transfer unit 50*b* has the same components with the transfer unit 50*a*. In other words, the transfer unit 50*b* has the drive roller 51 and drive roller 52, the intermediate transfer belt 58, and the intermediate transfer rollers 53. The transfer unit 50*b* further includes a transfer member holder 59 for supporting the components of the transfer unit 50*b*.

The transfer member holder 59 includes protruding parts 59*c* capable of engaging in engaging grooves 89*a* and 89*b*

(FIG. 9) described later, and cutout parts 59*a* and 59*b* for engaging with protruding parts 55*a* described later.

The printer 15 also includes a cleaning unit 55*b* in place of the above-described cleaning unit 55 of the printer 10. The cleaning unit 55*b* has the same components with the cleaning unit 55. In other words, the cleaning unit 55*b* has the scraping member 56 and the case 57. As shown in FIG. 8(*b*), the cleaning unit 55*b* further has protruding parts 55*a* that can be slid along and engaged with in the cutout parts 59*a* and 59*b* formed in the transfer member holder 59. With this construction, the cleaning unit 55*b* can be mounted and removed independently of the transfer member holder 59.

Figure 9:
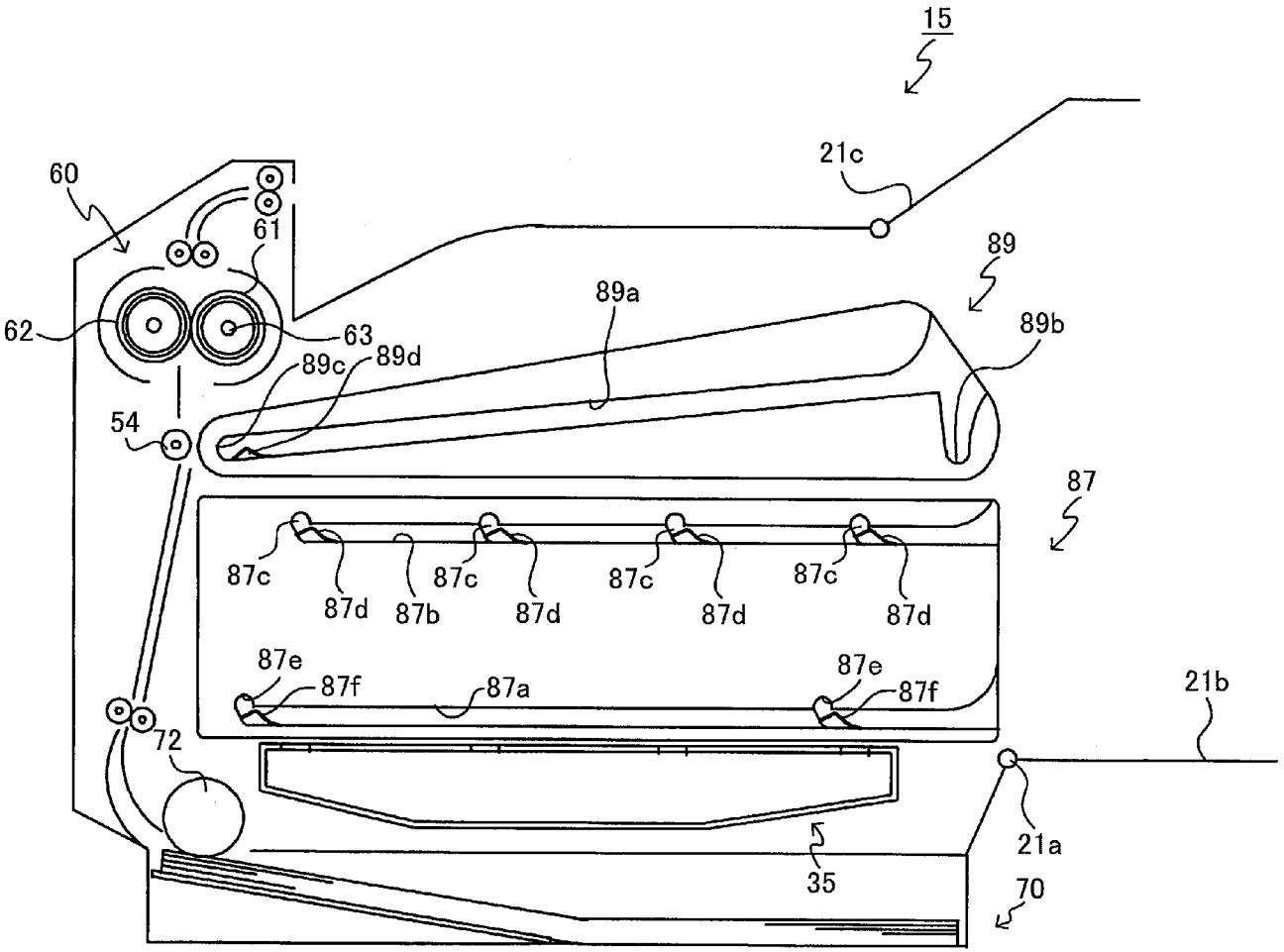
FIG. 9 is a side view of the printer showing guide mechanisms provided in the main body of the printer and used for mounting the developing unit and the transfer unit into the printer.

As shown in FIG. 9, the body of the printer 15 includes a developer guide mechanism 87 for allowing the developing unit 11 to be freely mounted and removed, and a transfer unit guide mechanism 89 for allowing the transfer unit 50*b* to be freely mounted and removed.

The developer guide mechanism 87 includes the first engaging grooves 87*a* for engaging with the plurality of protruding parts 12*i* formed on the tray 12, and second engaging grooves 87*b* for engaging with the support shafts 32*a* of the photosensitive drums 32.

For each of the support shafts 32*a*, the second engaging grooves 87*b* of the developer guide mechanism 87 are provided with engaging parts 87*c* for engaging the support shafts 32*a*, and urging members (plate springs, for example) 87*d* for urging the support shafts 32*a* into the engaging parts 87*c* so as not to move therefrom.

For each of the protruding parts 12*i*, the first engaging grooves 87*a* are provided with engaging parts 87*e* for engaging with the protruding parts 12*i*, and urging members (plate springs, for example) 87*f* for urging the protruding parts 12*i* into the engaging parts 87*e* so the protruding parts 12*i* do not move therefrom.

Although not shown, the developer guide mechanism 87 has left-side and right-side guide walls similar to the left-side and right-side guide walls 85R and 85L described with reference to FIG. 5(*b*).

The second engaging groove 87*b* provided with the engaging parts 87*c* and the urging members 87*d* is formed in each of the left-side and right-side guide walls in the developer guide mechanism 87, and has the same configuration with the above-described second engaging groove 85*b* that is provided with the engaging parts 85*c* and the urging members 85*d* (FIG. 5(*a*), FIG. 5(*b*), and FIG. 5(*c*)).

Although not shown, slanted areas and end walls are formed in each second engaging groove 87*b* in the same manner as the above-described slanted areas 85*e* and the end walls 85*f* (FIG. 5(*a*), FIG. 5(*b*), and FIG. 5(*c*)). Although not shown, the male coupling members 40 are provided on the developer guide mechanism 87 in the same manner as described above with reference to FIG. 5(*c*).

Although not shown, the photosensitive drums 32 are held by the tray 12, with their support shafts 32*a* protruding in the same manner as described above with reference to FIG. 5(*b*). Both of the longitudinal ends (right-side and left-side ends) of the support shafts 32 that protrude out of the tray 12 are held in the engaging parts 87*c* of the second engaging grooves 87*b* by the urging members 87*d* on both of the right-side and left-side guide walls in the developer guide mechanism 87.

Although not shown, the photosensitive drums 32 have the drum gears 43 in the same manner as described above with reference to FIG. 5(*d*). The female coupling gears 41 and the intermediate gears 42 are provided in the tray 12 in the same manner as described above with reference to FIG. 5(*d*).

The protruding parts 12*i* on the front and rear sides of the tray 12 protrude outwardly from the tray 12 in the widthwise (right-to-left) direction with different protruding amounts in the same manner as the support shafts 32*a* described above with reference to FIG. 5(*b*).

The first engaging groove 87*a* provided with the engaging parts 87*e* and the urging members 87*f* is provided in each of the left-side and right-side guide walls of the developer guide mechanism 87, and has the same configuration with the above-described second engaging groove 87*b* that is provided with the engaging parts 85*c* and the urging members 85*d*. Although not shown, slanted areas and end walls are formed in each first engaging groove 87*a* in the same manner as the above-described slanted areas 85*d* and end walls 85*f*.

With this construction, the tray 12 can be inserted into the developer guide mechanism 87 along the first engaging grooves 87*a* and second engaging grooves 87*b* when mounting the tray 12 into the body of the printer 15 and can be fixed in a right position when the support shafts 32*a* are engaged with the engaging parts 87*c* and the protruding parts 12*i* are engaged with the engaging parts 87*e*. As a result, the photosensitive drums 32 are brought into contact with the intermediate transfer belt 58 as shown in FIG. 7 and FIG. 8(*a*). When removing the tray 12 from the body of the printer 15, the pulling force on the tray 12 opposes the urging force of the urging members 87*d* and urging members 87*f* until the support shafts 32*a* and protruding parts 12*i* separate from the engaging parts 87*c* and engaging parts 87*e*, respectively. As a result, the tray 12 moves slightly downwardly and forwardly along the slanted areas of the bottom surfaces of the first and second engaging grooves 87*a* and 87*b*, and the photosensitive drums 32 are brought out of contact with the intermediate transfer belt 58 as shown in FIG. 8(*b*) and FIG. 10. Subsequently, the tray 12 can be removed as the support shafts 32*a* and protruding parts 12*i* are guided along the second engaging grooves 87*b* and first engaging grooves 87*a*, respectively.

The first engaging grooves 87*a* and second engaging grooves 87*b* are formed at a slant near the engaging parts 87*c* and engaging parts 87*e* so that the photosensitive drums 32 are not damaged by sliding against the intermediate transfer belt 58 when removing the tray 12. In other words, the first engaging grooves 87*a* and second engaging grooves 87*b* are configured so that the photosensitive drums 32 will not contact the transfer unit 50*b* (intermediate transfer belt 58) until the support shafts 32*a* arrive in the engaging parts 87*c*.

The transfer unit guide mechanism 89 is disposed above the developer guide mechanism 87 and includes the engaging grooves 89*a* and 89*b* for engaging with the protruding parts 59*c* formed on the transfer member holder 59.

The engaging grooves 89*a* are formed at a slope that is higher on the front side of the printer 15 (the side toward the removal direction). The engaging grooves 89*a* include: engaging parts 89*c* on the rear side (the side away from the removal direction) for engaging the protruding parts 59*c* formed on the transfer member holder 59 at its rear side; and urging members 89*d* for urging the protruding parts 59*c* to prevent the protruding parts 59*c* from moving out of the engaging parts 89*c*. The engaging grooves 89*b* are formed in a substantially vertical direction and are for receiving the protruding parts 59*c* formed on the transfer member holder 59 at its front side.

When mounting the transfer member holder 59 in the transfer unit guide mechanism 89 having this construction, the protruding parts 59*c* are inserted into the engaging grooves 89*a* and 89*b* until the protruding parts 59*c* on the rear side contact the engaging parts 89*c*, at which time the transfer member holder 59 is fixed in position.

To remove the transfer member holder 59, the front side of the transfer member holder 59 (the protruding parts 59*c* at the front side that engage with the engaging grooves 89*b*) is lifted until the protruding parts 59*c* are extracted from the engaging grooves 89*b*. From this position (with the front side of the transfer member holder 59 lifted), the front side of the transfer member holder 59 is pulled to remove the transfer member holder 59.

With the printer 15 having the construction described above, the developer cartridges 31 can be removed individually, such as the magenta developer cartridge 31M shown in FIG. 10, by first opening the first door 21*b* and then pulling out the developing unit 11.

Figure 11:
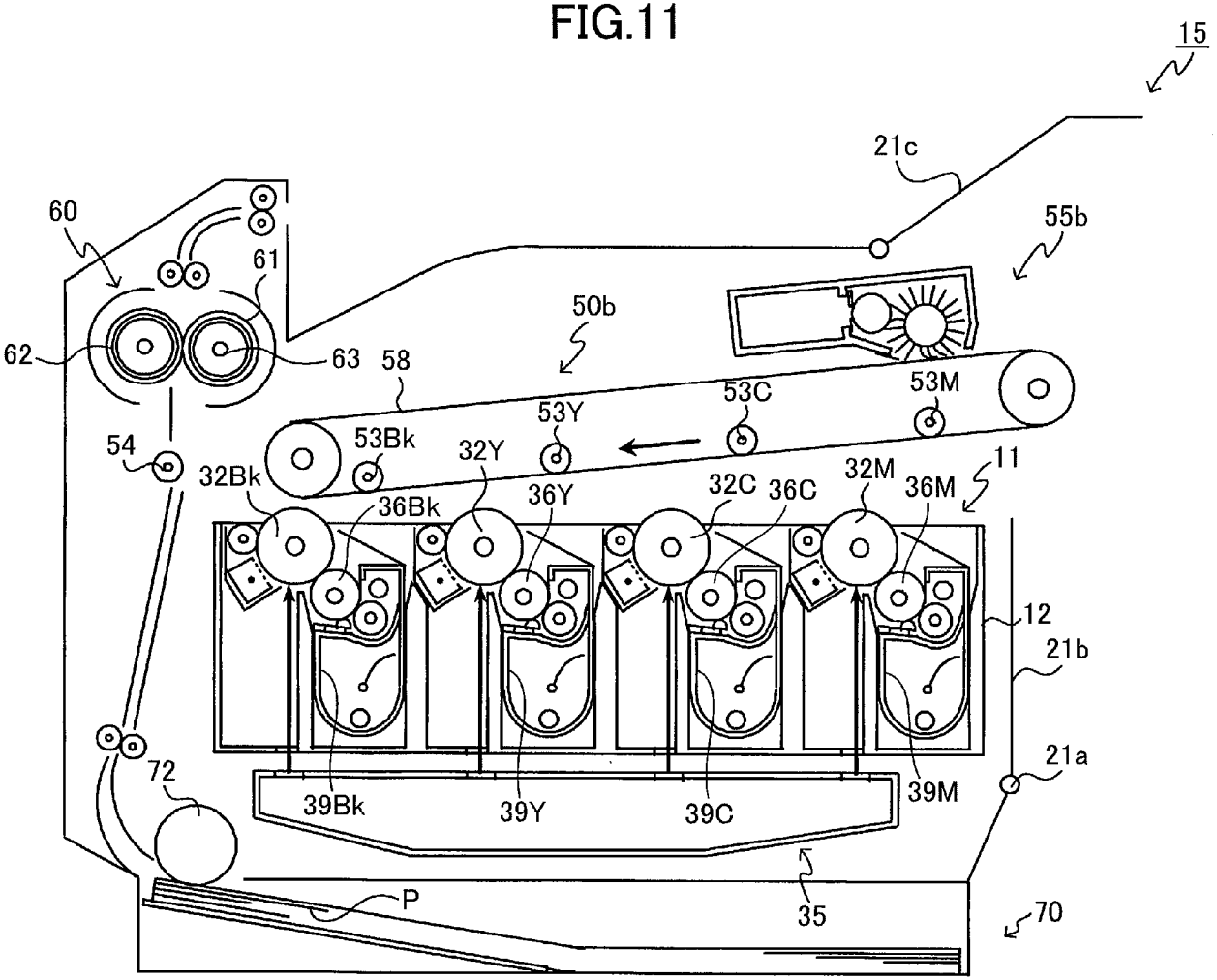
FIG. 11 is a side cross-sectional view of the printer in which the transfer unit is being removed.

As shown in FIG. 11, the transfer unit 50*b* can be removed by opening the second door 21*c*. At this time, the cleaning unit 55*b* is removed together with the transfer unit 50*b*.

Further, when the second door 21*c* is opened, the cleaning unit 55*b* alone can be removed without removing the transfer unit 50*b*. Hence, this construction facilitates maintenance of the cleaning unit 55*b*.

Since the transfer unit 50*b* is inserted and removed through the side of the printer 15 rather than the top, the mechanism for inserting and removing the transfer unit 50*b* can be employed in a multifunction device such as that shown in FIG. 6 with the scanner 110 provided on the top.

The printer 15 can obtain the same effects as those obtained by the printer 10.

While the invention has been described in detail with reference to the above-described aspects thereof, it would be apparent to those skilled in the art that various changes and modifications may be made therein without departing from the spirit of the invention.

In each of the above-described printers 10 and 15 and multifunction device 5, the plurality of photosensitive drums 32 are provided in one to one correspondence with the plurality of developer cartridges 31, that is, in one to one correspondence with the plurality of different colors. However, only a single photosensitive drum 32 may be provided for all the plurality of developer cartridges 31, that is, for all the plurality of different colors. In this case, the exposing device 35 forms a plurality of electrostatic latent images for the plurality of colors on the single photosensitive drum 32 at different locations or at different timings. Each developer cartridge 31 develops a corresponding electrostatic latent image formed on the photosensitive member into a visible image of a corresponding color. The transfer unit 50*a* or 50*b* transfers the visible images formed on the single photosensitive member to a recording medium. Or, two or more photosensitive drums 32, whose number is smaller than the number of the developer cartridges 31, may be provided. Each photosensitive drum 32 may be used for forming one or two electrostatic latent images to be developed by corresponding one or two developing cartridges 31.

A photosensitive member other than the photosensitive drum, such as a photosensitive belt, for example, may be used instead of the photosensitive drum.

What is claimed is:

1. An image-forming device, comprising:

a main body;

a plurality of photosensitive members arranged in a predetermined direction;

a transferring unit disposed above the photosensitive members and configured to transfer visible images formed on the photosensitive members to a recording medium, the transferring unit having a first end and a second end spaced apart from each other in the predetermined direction, the transferring unit including a pair of rollers and a belt supported by the pair of rollers; and a guide mechanism configured to guide the transferring unit to move between a contact position and a separated position, wherein when the transferring unit is at the contact position, the transferring unit is positioned such that the belt contacts the photosensitive members, and wherein when the guide mechanism guides the transferring unit to move from the contact position to the separated position, the transferring unit rotates, with the first end serving as a fulcrum, to move the second end upwardly, thereby separating the belt from the photosensitive members.

2. The image-forming device according to claim 1, further comprising a transfer roller located opposite the first end of the transferring unit.

3. The image-forming device according to claim 1, wherein the transferring unit further includes:

a first protruding part; and a second protruding part disposed on a side of the second end of the transferring unit with respect to the first protruding part in the predetermined direction, and wherein the guide mechanism includes:

a first guide groove configured to guide the first protruding part, the first guide groove being slanted upwardly in a direction from the first end to the second end; and a second guide groove configured to guide the second protruding part and opened upwardly.

4. The image-forming device according to claim 3, wherein the guide mechanism further includes:

an engaging part provided in the first guide groove; and an urging member configured to urge the first protruding part toward the engaging part.

5. The image-forming device according to claim 3, wherein the main body has a first door configured to change between a closed state closing a first opening and an opened state opening the first opening, and wherein when the first door is opened, the guide mechanism allows the transferring unit to be removed from the main body with the second end serving as a leading end.

6. The image-forming device according to claim 5, further comprising a holding unit configured to support the plurality of photosensitive members, wherein the holding unit includes a holding-unit first end and a holding-unit second end in the predetermined direction, the holding-unit first end being on a side of the first end of the transferring unit with respect to the holding-unit second end in the predetermined direction, wherein the main body has a second door configured to change between a closed state closing a second opening and an opened state opening the second opening, and wherein when the second door is opened, the holding unit is configured to be removed from the main body with the holding-unit second end serving as a leading end.

7. The image-forming device according to claim 1, wherein the main body has a first door configured to change between a closed state closing a first opening and an opened state opening the first opening, and wherein when the first door is opened, the guide mechanism allows the transferring unit to be removed from the main body with the second end serving as a leading end.

8. The image-forming device according to claim 7, further comprising a holding unit configured to support the plurality of photosensitive members, wherein the holding unit includes a holding-unit first end and a holding-unit second end in the predetermined direction, the holding-unit first end being on a side of the first end of the transferring unit with respect to the holding-unit second end in the predetermined direction, wherein the main body has a second door configured to change between a closed state closing a second opening and an opened state opening the second opening, and wherein when the second door is opened, the holding unit is configured to be removed from the main body with the holding-unit second end serving as a leading end.

* * * * *